US007056419B2

(12) United States Patent
Sundaram et al.

(10) Patent No.: US 7,056,419 B2
(45) Date of Patent: Jun. 6, 2006

(54) METHODS FOR MODIFYING ELECTRICAL PROPERTIES OF PAPERMAKING COMPOSITIONS USING CARBON DIOXIDE

(75) Inventors: V. S. Meenakshi Sundaram, Burr Ridge, IL (US); Daniel Duarte, Clarendon Hills, IL (US); Steven Fisher, Lyons, IL (US)

(73) Assignee: American Air Liquide, Inc., Fremont, CA (US)

( * ) Notice: Subject to any disclaimer, the term of this patent is extended or adjusted under 35 U.S.C. 154(b) by 125 days.

(21) Appl. No.: 10/656,857

(22) Filed: Sep. 6, 2003

(65) Prior Publication Data

US 2004/0118539 A1 Jun. 24, 2004

Related U.S. Application Data

(60) Provisional application No. 60/414,876, filed on Sep. 30, 2002.

(51) Int. Cl.
*D21H 21/06* (2006.01)
*D21H 23/08* (2006.01)

(52) U.S. Cl. ..... 162/158; 162/181.1; 162/181.2; 162/183; 162/198

(58) Field of Classification Search ..... 162/158, 162/181.1, 181.2, 183, 198
See application file for complete search history.

(56) References Cited

U.S. PATENT DOCUMENTS

| | | | | |
|---|---|---|---|---|
| 4,535,285 A | | 8/1985 | Evans et al. | |
| 5,043,017 A | | 8/1991 | Passaretti | |
| 5,156,719 A | | 10/1992 | Passaretti | |
| 5,365,775 A | | 11/1994 | Penniman | |
| 5,378,322 A | | 1/1995 | Hornsey | |
| 5,505,819 A | | 4/1996 | De Witt et al. | |
| 5,830,364 A | * | 11/1998 | Bleakley | 210/712 |
| 6,072,309 A | | 6/2000 | Watson et al. | |
| 6,176,974 B1 | * | 1/2001 | Hubbe | 162/158 |
| 6,228,161 B1 | | 5/2001 | Drummond | |

(Continued)

FOREIGN PATENT DOCUMENTS

| | | |
|---|---|---|
| EP | 0079726 | 11/1982 |
| EP | 0296198 B1 | 12/1987 |
| EP | 0 281 273 | 9/1988 |
| EP | 0 572 304 | 12/1993 |
| EP | 0991811 B1 | 6/1998 |

(Continued)

OTHER PUBLICATIONS

Dec. 18, 2003, International Search Report.

Copyright 2000, The American Heritage Dictionary of the English Language; Fourth Edtion; Houghton Mifflin Co.

(Continued)

*Primary Examiner*—Eric Hug
(74) *Attorney, Agent, or Firm*—Christopher J. Cronin

(57) ABSTRACT

Carbon dioxide may be used to adjust the electrical properties of papermaking compositions. Such papermaking compositions may contain a colloid phase, an aqueous phase, and optionally, pulp fibers. Examples of electrical properties whose values may be adjusted include zeta potential, electrical charge demand, conductivity, and streaming potential. The carbon dioxide may be introduced at many different points in a papermaking process, including calcium carbonate slurry feeds, pulp fiber slurries, diluted pulp fibers slurries, broke, and whitewater. When a value or range of values based upon an electrical property is predetermined, such as an optimal value or range, introduction of carbon dioxide may be used to adjust the value such that it is closer to the predetermined value.

32 Claims, 5 Drawing Sheets

U.S. PATENT DOCUMENTS

| | | | | |
|---|---|---|---|---|
| 6,251,356 | B1 | 6/2001 | Mathur | |
| 6,419,789 | B1 * | 7/2002 | Yeh et al. | 162/109 |
| 6,436,232 | B1 | 8/2002 | Silenius et al. | |
| 6,494,991 | B1 | 12/2002 | Lee et al. | |
| 6,537,425 | B1 | 3/2003 | Rheims et al. | |
| 6,540,870 | B1 | 4/2003 | Laurila-Lumme et al. | |
| 6,540,878 | B1 | 4/2003 | Leino | |
| 6,589,387 | B1 | 7/2003 | Leino et al. | |
| 6,599,390 | B1 | 7/2003 | Rheims et al. | |
| 2004/0118539 | A1 | 6/2004 | Sundaram et al. | |

FOREIGN PATENT DOCUMENTS

| | | |
|---|---|---|
| EP | 0 884 416 | 12/1998 |
| WO | WO 98/12551 | 3/1998 |
| WO | WO 98/56988 | 6/1998 |
| WO | WO 99/45202 | 3/1999 |
| WO | WO 92/54741 | 4/1999 |
| WO | WO 99/24661 | 5/1999 |
| WO | WO 99/35333 | 7/1999 |
| WO | WO 99 54741 | 10/1999 |
| WO | WO 00/47817 | 1/2000 |
| WO | WO 00/73756 | 5/2000 |
| WO | WO 01/04415 | 7/2000 |
| WO | WO 01/75221 | 4/2001 |
| WO | WO 02/097189 | 5/2002 |
| WO | WO 03/050356 | 6/2003 |
| WO | WO 03 074788 | 9/2003 |

OTHER PUBLICATIONS

Copyright 1992, Chemical Processing Aids in Papermaking; A Practical Guide; Kevin J. Hipolit, Editor: Philip M. Hoekstra, Chairman.

IMPS 2002–Presentation, Neutralization with CO2 Feasibility in Photo Paper; Besser, Kleeman, Leigraf.

Apr. 26, 1995, 00514700 PaperChem No.: AB6517018: Interactions Between Cationic Starches and Papermaking Fibers; Effect of Starch Characteristics on Fiber Surface Charge and Starch Retention; B. Gupta and W. Scott.

Copyright 1992, 00350859 PaperChem No.: AB6500859; Wet–End Chemistry of Retention; Drainage and Formation Acids; J.E. Unbehend.

Sep. 1989, 00284306 PaperChem No. AB6107175; Use of Potentiometric Titration and Polyelectrolyte Titration to Measure the Surface Charge of Cellulose Fiber; R.I.S. Gill; vol. 1: 437–452: Conference Literature.

Jun. 1984, 00207496 PaperChem No.: AB5508465; Adsorption of Ions at the Cellulose?Aqueous Electrolyte Interface; T.M. Herrington and B.R. Midmore; JCS Faraday I 80, No. 6: 1525–1566.

Copyright 1978, 00146149 PaperChem No.: AB5008078; Surface Phenomena; J. d'A Clark; Pulp Technol. & Trmt. for Paper, Chap. 4: 87–105.

May 15, 1989, 00141038 PaperChem No.: AB5002967; Interfacial Properties of Polyelectrolyte–Cellulose Systems; F. Onabe; J. Appl. Polymer Sci. 23, No. 10: 2909–2922; cf. ABIPC 49.

Nov. 1978, 00137406 PaperChem No. AB4909775; Comparative Evaluation of Electrokinetic Behavior of Polyelectrolyte–Cellulose Systems; F. Onabe.

Jul. 1977, 00120629 PaperChem No.: AB4804688; Adsorption and Flocculation Mechanisms in Paper Stock Systems; K.W. Britt, A.G. Dillon and L.A. Evans.

Dec. 1975, 00101645 PaperChem No.: AB4610134; Zeta–Potential Measurements inPaper Manufacture; T. Lindstrom and C. Soremark; Papier 29 No. 12: 519–525.

Jan. 1975, 00089534.PaperChem No.: AB4510693; Drainage and Retention Mechanisms of Papermaking Systems Treated with Cationic Polymers; Tappi 58, No. 1:99–101.

Jun. 1974, 00084680 PaperChem No.: AB4505839; Importance of Electrokinetic Properties of Wood Fiber for Papermaking; T. Lindstrom, C. Soremark, C. Heinegard and S. Martin–Lof; TAPPI Papermakers Conf. (Boston): 77–84.

Jul. 1969, 00024862 PaperChem No.: AB4004810; Influence of a Alum and pH on the Zeta Potential of Fibers and Additives; A.W. McKenzie, V. Balodis and A. Milgrom; Appita 23, No. 1: 40–4.

Mar. 1967, 00003679 PaperChem No.: AB3803679; Retention and Retention Aids; C.J.J. Ninck Blok and B. de Klein; Papierwereld 22, No. 3: 69–81, Dutch; Engl. sum.

Oct. 1997, 00589937 PaperChem No.: AB6806087; Online Cationic–Demand Measurement for Wet–End Papermaking; C. Veal (Chemtrac Systems); Conference: 1997 Engineering and Papermakers: Forming Bonds for Better Papermaking.

Jan. 15, 1996, 00545901 PaperChem No.: AB6700058; Starches for Surface Sizing and Wet–End Addition; P.H. Brouwer; Wochenbl. Papierfabr. 124, No. 1: 19–26.

* cited by examiner

METHODS FOR MODIFYING ELECTRICAL PROPERTIES OF PAPERMAKING COMPOSITIONS USING CARBON DIOXIDE

CROSS-REFERENCE TO RELATED APPLICATIONS

This application claims priority under 35 U.S.C. 119(e) to U.S. provisional application 60/414,876 filed on Sep. 30, 2002, and incorporates its disclosure in its entirety by reference.

BACKGROUND

This invention is directed to papermaking processes and systems. More particularly, this invention is directed to adjustment of electrical properties of papermaking compositions.

Paper is made by mixing a number of colloidal, polymeric, and solution components and then allowing the colloidal suspension to flow through a narrow slit onto wire gauze. The paper pulp is a pseudoplastic material with a well-defined yield value. The magnitude of the yield stress and the way in which the viscosity changes with shear rate are important in producing a smooth outflow of the pulp and an appropriate thickness on the moving wire gauze. Those flow characteristics should be monitored and adjusted if necessary.

The colloid science covers a wide range of seemingly very different systems. Many natural and man-made products and processes can be characterized as being colloidal systems. For example, commercial products such as shaving cream and paints, foods and beverages such as mayonnaise and beer, and natural systems such as agriculture soils and biological cells are all colloidal systems.

Colloids in simple terms are an intimate mixture of two substances. The dispersed or colloidal phase in a finely divided state is uniformly distributed through the second substance called the dispersion or dispersing medium. The dispersed phase can be a gas, liquid or solid. The size of colloidal substance present in dispersing medium can vary in size approximately between 10 to 10,000 angstroms (1 to 1000 nanometers)(The American Heritage Dictionary, fourth edition, Houghton Miflin Company, p.365, 2000). The distribution of electric charge and electrostatic potential in the immediate neighborhood of the surface of a colloidal particle is important. The reason for this is that many transport properties, such as electrical conductivity, diffusion coefficient and the flow of many systems are determined by charge distribution.

As indicated above, a papermaking composition (or paper furnish) is generally made up of materials (fiber, filler, etc.) and a bulk phase, normally water, containing dissolved and colloidally dispersed materials (salts, polymers, dispersants, etc.). Although the overall, or average charge of the total furnish (particulate and water phases) must be neutral (principle of electro-neutrality). However, individual components can be positive (cationic), negative (anionic), or neutral. Morerover, each particle will have a specific average charge, derived from many individual cationic and anionic sites, and the water phase will have an "average" charge from dissolved and colloidal matter.

The surface chemical properties of the fibers and fines depend on chemical composition of the surface of the fiber or fine. For example, pulp fibers resulting from mechanical and/or chemical pulping processes, when dispersed in water, acquire a certain charge. There are several ionizable groups that are present in wood pulp, such as hemicellulose and lignin carboxyl groups, lignin phenolic OH groups, sugar alcohol groups, hemiacetal groups, and lignosulphonate groups.

Fiber and fines can also acquire charge, depending upon type and concentration of dissolved substances in the water. For example, dissolved salts tend to have an ion-exchange behavior and resulting charge on pulp fibers can either be negative (or) positive (or) neutral. The strength of attraction (ion adsorption) by the carboxyl groups is a function of ion valency and species. The strength of attraction of wood fibers for various ions occurs in the following order: $Na^{+}<K^{+}<Ag^{+}<Ca^{2+}=Mg^{2+}=Ba^{2+}<Al^{3+}$ (William E.Scott, Wet End Chemistry, TAPPI, Ed.1996, page 16.).

Additives ae equally important with respect to the above issues. Many of the additives listed in Table 1 have a surface charge. The type and intensity of charge vary based on the additive used. These chemical include retention aids, flocculants, drainage aids, resins, dispersants, chelants, scale inhibitors, corrosion inhibitors, slimicides, and the like.

TABLE 1

| Wet End Chemical Additives | |
|---|---|
| Internal sizes | Cationic flocculants |
| External sizes | Alum (papermakers alum), and alum substitutes such as polyaluminimum chloride, polyaluminium hydroxychloride, and polyaluminium silicate sulfate |
| Rosins(colophony), typically fatty organic acids, such as abietic acid | Dyes |
| Rosin soaps (for example sodium abietate) | Acid dyes, typically used with a dye fixing agent |
| Starch sizes | Basic dyes |
| Cereal starch (corn, wheat) | Direct dyes |
| Tuber starch (for example potato, tapioca) | Pigment dispersions |
| Unmodified starches | Liquid sulfur dyes |
| Modified starches | Optical brightening agents (OBA) |
| Oxidized starches | Diaminostilbene disulfonic acid derivatives |
| Starch (cationic/anionic) | OBA quenchers |
| Amphoteric starches | Quaternary polyamides |
| Starch esters | Retention aids, drainage aids |
| Hydrophobic starches | Single polymer systems |
| Acid modified starches | Polyacrylamides |
| Hydrolyzed starches | Polydiallyldimethylammonium chloride |
| Alklaine (neutral) sizes | Polyethyleneimine |
| Alkyl ketene dimmer (AKD) | Acrylic acid/acrylamide polymers |
| Alykenyl succinic anydrided (ASA) | Dual polymer systems |
| Neutral rosin sizes | |
| Wax(either paraffin or microcrystalline) | |
| Fluorochemicals | |
| Dry strength resins (such as styrene-acrylate copolymers, styrene-maleic anydride copolymers, polyacrylamides, polyurethane, and polyvinyl alcohols) | |

The type of water used, and variations in process conditions employed, can also influence the amount and quantity of ions present. The current industrial trend is to minimize the use of fresh water during papermaking and recycle more and more of the process water. Recycling the process water increases ions built up in the system. The dissolved charges in water are mainly due to the presence of various soluble salts present in their ionic form, such as sodium, calcium, chloride and sulfates.

A common method of evaluating surface charge is by determining the zeta potential (rather tham measuring the actual surface charge). Zeta potential is explained as the charge potential at the interface plane between the Stern Layer and Gouy-Chapman region of an electrical double layer. The strength of these potentials and the distance involved determine the resistance of hydrophobic suspensions to coagulate or flocculate (William E.Scott, Wet End Chemistry, TAPPI, Ed.1992, page 3–4). Zeta potential is frequently used by papermakers as an indication of the state of electrokinetic charge in the system.

The use and measurement of zeta potential offers several benefits to a papermaker. It can provide adsorbing capacity of pulp fibers to a given additive. It can also help to choose the type of additive required to achieve a charge balance. Moreover, it can be used to predict upsets by flagging deviations from a set point.

Some representative disclosures of zeta measurement and its advantages to papermakers include: WO 99/54741 A1 (Goss et al.), EP 0 079 726 A1 (Evans et al.), WO 98/12551 (Tijero Miguel), and U.S. Pat. No. 4,535,285 (Evans et al.), "Wet-End Chemistry of Retention, Drainage, and Formation Aids", Pulp and Paper Manufacture, Vol. 6: Stock Preparation (Hagemeyer, R. W., Manson, D. W., and Kocurek, M. J., ed.), Unbehend, J. E., Chap. 7: 112–157 (1992), "Use of Potentiometric Titration and Polyelectrolyte Titration to Measure the Surface Charge of Cellulose Fiber", Gill, R. I. S., Fundamentals Pmkg. (Baker & Punton, ed.) Trans. 9th Fundamental Res. Symp. (Cambridge), Vol. 1: 437–452 (September 1989), "Adsorption of Ions at the Cellulose/Aqueous Electrolyte Interface", Harrington, T. M.; Midmore, B. R, JCS Faraday I 80, no. 6: 1525–1566 (June 1984), "SURFACE PHENOMENA", Clark, J. d'A, Pulp Technol. & Trmt. for Paper (Miller Freeman Publns.), Chap. 4: 87–105 (1978), "ADSORPTION AND FLOCCULATION MECHANISMS IN PAPER STOCK SYSTEMS", Britt, K. W.; Dillon, A. G.; Evans, L. A., TAPPI Papermakers Conf. (Chicago) Paper IIA-3: 39–42 (Apr. 18–20, 1977), and ZETA-POTENTIAL MEASUREMENTS IN PAPER MANUFACTURE", Lindstrom, T.; Soremark, C., Papier 29, no. 12: 519–525 (December 1975).

The zeta potential values measured during papermaking are system dependent and change due to process variations and upsets. Considerable deviations in zeta potential from a system's optimum will affect the production and quality of cellulose products. Generally speaking, many have proposed that a zeta close to zero or slightly negative is desirable. However, a targeted zeta potential value for a specific paper machine is a function of several factors, such furnish type, production rates, product grades, the ambient conditions, the particular operator on duty, the particular starting materials, and additives.

One way of avoiding or rectifying zeta deviations or flagged upsets is by adjusting the papermaking process by introducing additives to various portions/stages thereof. However, introduction of additives has significant drawbacks.

First, introducing additives to the process presents unknown chemical interactions with the papermaking composition. Unforeseen chemical reactions may result in reaction products whose effect upon the process is undesirable. Without more knowledge of these chemical reactions, it is difficult to adjust the process conditions to rectify the undesirable effect.

Secondly, introducing additives to the process over time creates a buildup of the additives and of the known reaction products of the additives and components of the papermaking composition. Once an upper limit of concentration(s) for any or more of these is reached, the process must be shut down. In that case, the operator may be forced to discard pulp or treat it so that it may be recycled. The operator may also have to drain the process of the aqueous components of the papermaking compositions, and replenish them with fresh water and additives. Most importantly, production is significantly decreased.

Thirdly, introducing additives to the process also complicates the physical interactions of fibers, colloidal species and dissolved species within the papermaking composition. For example, if colloids having a significant surface charge are not suitably neutralized, they may agglomerate with oppositely charged species, thereby resulting in flocculation at an inappropriate time during the process. Conversely, agglomeration and flocculation may not occur at the appropriate time, or at all, if the colloids do not have a sufficient charge, i.e., they remain suspended in the aqueous phase.

Fourthly, some additives may undesirably react with various mechanical parts in the process. Corrosion of these parts over time may lead to mechanical breakdowns. As a result, the process must be shut down and the part at issue repaired or replaced. This is often very costly.

Despite the above drawbacks, many have proposed addition of cationic or anionic chemical additives. Several have proposed various strategies for this type of modification.

U.S. Pat. No. 6,072,309 (Watson et al.) suggests the use of electrolytes such as cations (including dissolved aluminum and iron cations) in order to adjust the zeta potential.

U.S. Pat. No. 5,365,775 (Penniman) discloses adjustment of the zeta potential via addition to the papemaking process of an appropriate polymer.

The abstract from "INTERFACIAL PROPERTIES OF POLYELECTROLYTE-CELLULOSE SYSTEMS; ELECTROKINETIC PROPERTIES OF CELLULOSE FIBERS WITH ADSORBED MONOLAYERS OF CATIONIC POLYELECTROLYTE", Onabe, F., J. Appl. Polymer Sci. 23, no. 10: 2909–2922 (May 15, 1979) discloses zeta-potential measurements on acetate-grade dissolving pulp fibers with and without irreversibly adsorbed monolayers of cationic polyelectrolyte, viz., poly(dimethyl diallyl ammonium chloride). As the amount of adsorbed polymers increased, the negative zeta-potential of the fibers decreased until the polarity of the zeta-potential was reversed to the positive side. A marked change in the value of zeta-potential was not observed when the formation of the saturated monolayer was completed. The abstract suggests that the charge of the cellulose fibers can be controlled until formation of a saturated monolayer of cationic polyelectrolytes if the number of adsorbed segments per unit area of fiber surface at saturated monolayer formation is greater than the number of carboxyl groups per unit area of fiber surface The abstract for "COMPARATIVE EVALUATION OF ELECTROKINETIC BEHAVIOR OF POLYELECTROLYTE-CELLULOSE SYSTEMS", Onabe, F., J. Soc. Fiber Sci. Technol. Japan (Sen-i Gakkaishi) 34, no. 11: T494–504 (November 1978) discloses studies conducted to elucidate the mechanism of electrostatic charge control in pulp fibers by cationic wet-end additives and the function of counterions in controlling the surface electric charge. In systems with irreversibly adsorbed polymer layers, the negative zeta-potential of fibers with monolayers reversed polarity to a positive value, whereas the zeta-potential for multilayers remained negative with increased salt concentrations. Among systems containing counterions of various valencies, the polarity of both positively and negatively charged fibers reversed upon increase of salt concentration. Of the two systems simulating paper-machine wet-end operation, negatively charged fibers remained negative with increased alum additions, but reverted to a positive charge upon increased dosage of the polyelectrolyte. Electric double-layer models are proposed to account for the electrokinetic behavior of the systems. The significance of specific adsorption of polyvalent counterions for effective charge control on the fibers is demonstrated.

The abstract for "DRAINAGE AND RETENTION MECHANISMS OF PAPERMAKING SYSTEMS TREATED WITH CATIONIC POLYMERS", Moore, E. E., Tappi 58, no. 1: 99–101 (January 1975) discloses that optimum drainage or retention of a papermaking system in which a drainage and retention aid is used does not necessarily correlate with the point of charge neutralization of the substrate surface. In a bleached pulp suspension containing alum, drainage or retention can increase greatly with increasing amounts of cationic polyacrylamide, even though the fiber surface has been charge reversed. The lack of correlation of these props. with zero zeta-potential shows that mechanisms other than charge neutralization may predominate.

The abstract for "IMPORTANCE OF ELECTROKINETIC PROPERTIES OF WOOD FIBER FOR PAPERMAKING", Lindstrom, T.; Soremark, C.; Heinegard, C.; Martin-Lof, S., Conference: TAPPI Papermakers Conf. (Boston), TAPPI Papermakers Conf. (Boston): 77–84 (Jun. 3–6, 1974) discloses varing of the zeta potential and thus the tendency for flocculation by adding cationic polyacrylamides (PAA) to dispersions of cellulosic matl. (microcryst. cellulose sol). Optimum flocculation occurred at a zeta potential of ca. zero. Mill trials to determine a correlation between zeta potential and single pass retention on the wire showed increased retention as the zeta potential was lowered.

The abstract for "RETENTION AND RETENTION AIDS", Ninck Blok, C. J. J.; Klein, B. de, Papierwereld 22, no. 3: 69–81 (March, 1967) discloses a clear relation of cationic retention aids adsorption to exposed fiber surface. Zeta-potential measurements of pulp fibers as a function of adsorbed amount of cationic retention aids show a change from negative to positive charge values. It suggests that increased retention is probably due to changes in zeta-potential.

The abstract for "Online Cationic-Demand Measurement for Wet-End Papermaking", Veal, C., 1997 Engineering & Papermakers: Forming Bonds for Better Papermaking Conference, (TAPPI Press): 287–296 (Oct. 6, 1997; TAPPI Press) discloses optimized control of cationic materials enhances strength properties and improves runnability, drainage, and formation through measurement of colloidal and dissolved charge demand to determine or detect changes in furnish charge characteristics before the stock reaches the paper machine.

The abstract from "Starches for Surface Sizing and Wet-End Addition", Brouwer, P. H., Wochenbl. Papierfabr. 124, no. 1: 19–23 (Jan. 15, 1996) discloses that paper-machine wet-end operation gives the best results when electric charges at both the fiber surface (zeta potential) and in the aqueous phase (soluble charge) are near zero, and suggests that suitable cationic additives (such as polyacrylamide) be used.

Still others have proposed addition of other additives.

The abstract from "Interactions Between Cationic Starches and Papermaking Fibers; Effect of Starch Characteristics on Fiber Surface Charge and Starch Retention", Gupta, B. Scott, W., 1995 Papermakers Conference: Proceedings (TAPPI): 85–96 (Apr. 26, 1995; TAPPI Press) discloses that, in terms of time-dependent behavior, starch DS and dosage level were the most significant factors affecting surface charge, and suggests that, when selecting a starch for a particular application, starch-retention measurements should be carried out and that starch DS and dosage levels should be the variables manipulated.

The abstract for "INFLUENCE OF ALUM AND pH ON THE ZETA POTENTIAL OF FIBERS AND ADDITIVES", McKenzie, A. W.; Balodis, V.; Milgrom, A., Appita 23, no. 1: 40–4 (July, 1969) discloses that the negative charge normally found on fibers, on starch, and on titanium dioxide could be reversed in the presence of the Al sulfate. In most cases, the reversal of charge resulted from the adsorption of colloidal alumina on the surface of the fiber or the additives.

Outside of the above area of electrical properties, some have proposed adding carbon dioxide ($CO_2$) to papermaking processes for a variety of reasons.

WO 99/24661 A1 discloses improvement of drainage of a pulp suspension by treating it with carbon dioxide just before a dewatering device.

U.S. Pat. No. 2002/0092636 A1 and U.S. Pat. No. 6,599,390 B2 disclose addition of carbon dioxide in several reactors containing pulps including calcium hydroxide or calcium oxide in order to precipitate different forms of calcium carbonate.

U.S. Pat. No. 2002/0148581 A1 discloses regulation of broke pH with addition of carbon dioxide.

U.S. Pat. No. 2002/0162638 A1 discloses precipitation of additives in pulp suspensions with carbon dioxide having lowered purity.

U.S. Pat. No. 2002/0134519 A1 discloses eliminating detrimental substances by forming metal hydroxides through pH control with carbon dioxide.

U.S. Pat. No. 6,251,356 B1 discloses precipitation of calcium carbonate from a pressurized reactor containing calcium hydroxide or calcium oxide.

U.S. Pat. No. 6,436,232 B1 and U.S. Pat. No. 6,537,425 B2 disclose addition of carbon dioxide to pulps containing calcium hydroxide in order to precipitate calcium carbonate.

Despite these disclosures, none have recognized interaction between carbon dioxide and electrical properties of the papermaking composition, such as zeta potential, conductivity and electrical charge demand. None of them have disclosed addition of carbon dioxide to papermaking compositions based upon measurement of electrical properties of a papermaking composition, such as zeta potential, conductivity and electrical charge demand. None have appreciated the advantages of adding carbon dioxide upon the electrical properties of papermaking compositions.

Thus, those skilled in the art will appreciate that there is a need for more suitable additives for papermaking systems in order to adjust electrical properties of papermaking compositions such as zeta potential, conductivity, electrical charge demand, and streaming potential. They will also appreciate that there is a need for an additive that will not tend to build up over time such that the papermaking process must be shut down undesirably frequently. They will further appreciate that there is a need for an additive that will not adversely affect the mechanical parts of a papermaking machine. They will still further appreciate that there is a need for an additive that will improve properties of pulp fiber slurries, diluted pulp fiber slurries, broke, whitewater, paper webs and paper sheets when added to papermaking processes.

SUMMARY OF THE INVENTION

It is an object of the invention to provide improved methods of adjusting electrical properties of papermaking compositions, such as zeta potential, electrical charge demand and conductivity. It is another object to provide improved methods of adjusting electrical properties of papermaking compositions that employ a more suitable additive that will not tend to build up over time such that the papermaking process must be shut down undesirably frequently. It is yet another object of the invention to provide improved methods of adjusting electrical properties of papermaking compositions that employ an additive that will not adversely affect the mechanical parts of a papermaking machine. It is a further object to provide improved methods of adjusting electrical properties of papermaking compositions that employ an additive that will improve properties of pulp fiber slurries, diluted pulp fiber slurries, broke, whitewater, paper webs and paper sheets when added to papermaking processes.

In order to meet these needs and others, a method for adjusting electrical properties of papermaking compositions is provided that includes the following steps. At least one papermaking composition is provided that includes a colloid phase, an aqueous phase, and optionally pulp fibers. Each of the colloid phase, aqueous phase, and optional pulp fibers of one of the at least one papermaking composition has an electrical property and an associated value based upon the electrical property. Carbon dioxide is introduced into at least one of the at least one papermaking composition in an amount such that the associated electrical property value is substantially adjusted.

Also, a method for reducing an amount of chemical additives introduced to a papermaking composition is provided that includes the following steps. At least one papermaking composition is provided that includes a colloid phase, an aqueous phase, and optionally pulp fibers. Each of the colloid phase, aqueous phase, and optional pulp fibers of one of the at least one papermaking composition has an electrical property and an associated value based upon the electrical property. An amount of chemical additives is introduced into at least one of the at least one papermaking composition. An amount of amount of carbon dioxide is introduced into the at least one of the at least one papermaking composition into which the chemical additives are introduced while at the same time reducing the amount of the chemical additives. The amount of carbon dioxide is such that the associated electrical property value is substantially adjusted.

DETAILED DESCRIPTION OF THE INVENTION

Figure 1:
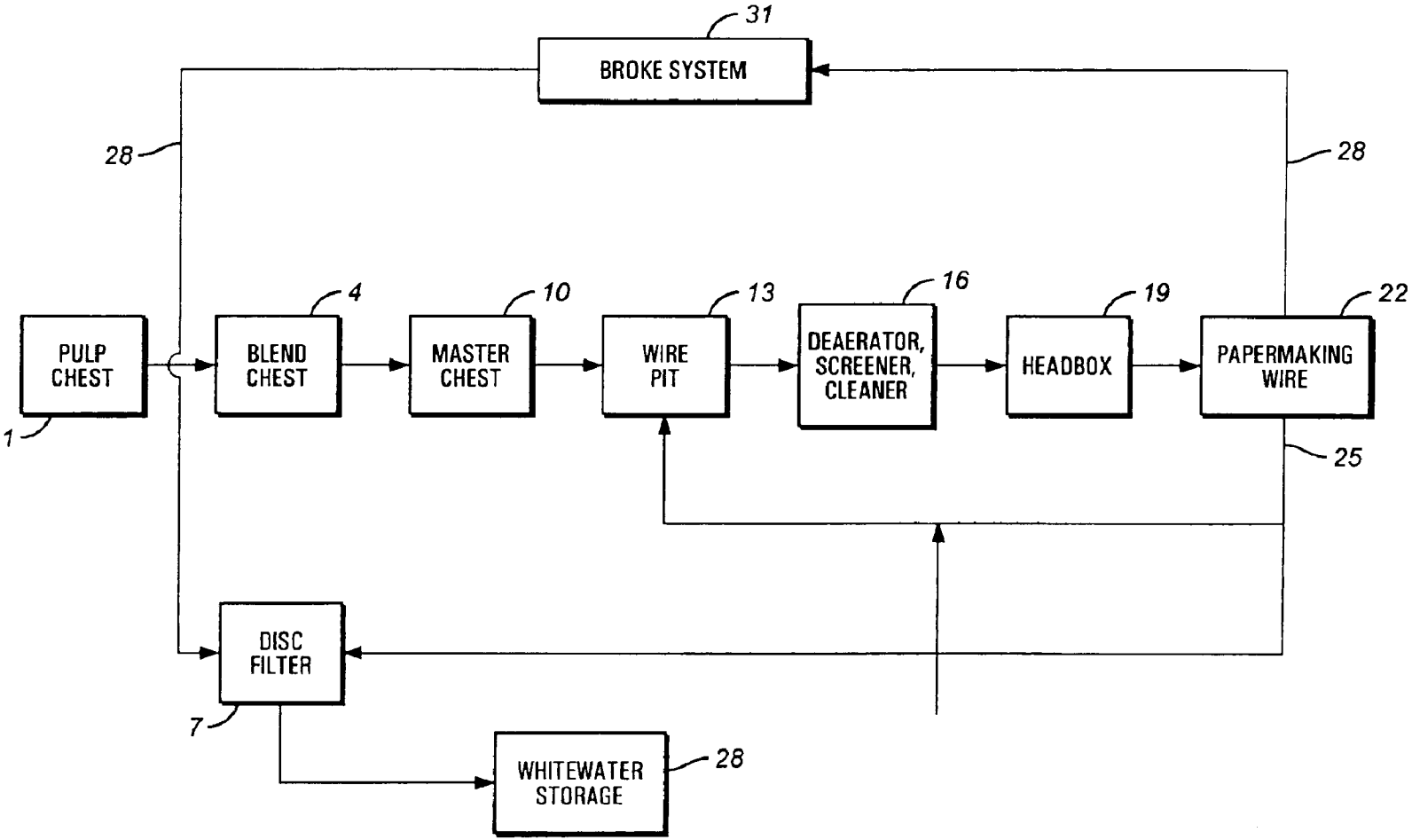
FIG. 1 is a schematic of a system suitable for performing the inventive method.

We have surprisingly discovered that introduction of carbon dioxide into papermaking compositions may be used to modify various electrical properties of components in the composition. Adjustment of these electrical properties yield many benefits for papermaking processes and systems, paper webs, and sheet paper produced by them.

An important benefit of this invention is that it minimizes the use of additional chemicals such as starch, polymer, etc. that are necessary to modify the zeta potential. It also helps in minimizing additional chemical buildup in the system. For example, if introduced in such a manner as to minimize variations in the electrokinetic properties of pulp slurries and/or furnishes, the addition of $CO_2$ would be beneficial. It is a well established fact that the electrokinetic properties of a furnish can have a significant impact on retention, drainage (during web formation), and paper properties. Variations in parameters such as retention and drainage can have an immediate effect on the tension control of the machine. This would affect dimensional stability and can lead to non-uniform web properties and possibly web breaks (i.e., down time).

In the inventive method, carbon dioxide is introduced into at least one papermaking composition, wherein each of the papermaking composition(s) includes a colloid phase, an aqueous phase and optionally fibers. At least one of the a colloid phase, aqueous phase and optional fibers of one of the papermaking composition(s) has an electrical property and an associated electrical property value based upon the electrical property. The carbon dioxide is then introduced in an amount such that the measured electrical property value is substantially adjusted.

The phrase, "substantially adjusted", means that the electrical property value is adjusted at least about one percent for a an aqueous slurry of bleached pulp fibers or two percent for an aqueous slurry of bleached pulp fibers blended with components found in white water. It is also within the scope of the invention for the property value to be adjusted more than "substantially", such as an adjustment greater than about five percent.

Preferably, practice of the invention involves up to four papermaking compositions. The first papermaking composition includes a slurry of pulp fibers, a colloid phase and an aqueous phase. The second and third papermaking compositions are broke and whitewater, respectively. The fourth (optional) papermaking composition is a diluted version of the first papermaking composition. Preferably, the first papermaking composition is diluted to provide the fourth papermaking composition.

Broke is the composition resulting from recycling unused paper back into the papermaking process.

Any one of the papermaking compositions may be the one whose component's electrical property is measured, and which also receives the introduced carbon dioxide. Alternatively, the papermaking composition (whose component's electrical property is measured) is different from the papermaking composition that receives the carbon dioxide. Alternatively, the carbon dioxide is introduced into at least two papermaking compositions, one of which may or may not be the one whose component's electrical property is measured. Preferably, the second papermaking composition is the one that receives the carbon dioxide. Preferably, the second papermaking composition is the one in which its component(s) electrical properties are measured.

The electrical property includes, without limitation, zeta potential, conductivity, electrical charge demand, streaming potential, and the like. Preferably, the electrical property is selected from the group comprising zeta potential, conductivity, electrical charge demand, streaming potential, and combinations of two or three thereof. More preferably, the electrical property is zeta potential or electrical charge demand. Most preferably, it is zeta potential.

The electrical property and adjustments thereof may be measured by a measuring device that reports a value based upon the electrical property. Carbon dioxide may be introduced into any papermaking composition, including but not limited to: a slurry of bleached pulp fibers (whether diluted or not); a slurry of bleached pulp fibers (whether diluted or not) combined with whitewater; a slurry of bleached pulp fibers (whether diluted or not) combined with broke; a slurry of bleached pulp fibers (whether diluted or not) combined with whitewater and broke; broke; and whitewater. Also, the measuring device may be in-line or off-line.

Since each of the components of each of the papermaking composition(s) has an electrical property, each of these components has a value based upon the electrical property. The phrase, "based upon", includes without limitation, values directly reported by a measuring device (analog values) and values mathematically derived from the analog values. In other words, the value is an expression of the quality of the electronic property. For example, the electrical property of zeta potential has a value expressed in units of mV, while the electrical property of electrical charge demand has a value that is often expressed in terms of mL of cationic or anionic titrant. As another example, conductivity typically has a value expressed in units of milliSiemens (mS), microSiemens (μS), millimhos or microhmos. As a further example, streaming potential typically has a value expressed in units of mA or streaming potential units (SPUs).

Each electrical property for each component of each composition is not necessarily the same. Rather, the phrase, "wherein each of a colloid phase, aqueous phase, and optional pulp fibers, of each of the at least one papermaking composition has a corresponding electrical property value based upon the electrical property" is considered to be quite inclusive of a plurality of combinations/permutations. It means that for each papermaking composition, each one of the components (suspended solids, aqueous phase, and pulp fibers (if included)) has a value for an electrical property associated with that component. It does not require that a same electrical property apply to each of the components of the papermaking composition at issue. For example, the electrical property for the pulp fibers could be zeta potential, while the electrical property of the aqueous phase could be electrical charge demand. As another example, the electrical property for the pulp fibers and that for the aqueous phase could also be the same. It also means that different papermaking compositions (if more than one is included) need not have the same electrical property for corresponding components. For example, in a first papermaking composition, the electrical property of the aqueous phase could be conductivity, while the electrical property of the aqueous phase in a second papermaking composition could be electrical charge demand.

Pulp included in the invention is lignocellulosic raw material that has undergone a pulping process. Preferably, it is bleached. Fibers are long, cylindrical lignocellulosic cells, including fiber tracheids with bordered pits and libriform fibers with simple pits. Fibers have a length that may be differentiated from fines. Those skilled in the art will appreciate that fines include very short fibers, fiber fragments, ray cells or debris from mechanical treatment that will pass through a standard mesh screen, such as 200 mesh.

Types of papermaking composition contemplated by the invention include, without limitation: a slurry of bleached pulp fibers; a slurry of bleached pulp fibers combined with whitewater; a slurry of bleached pulp fibers combined with broke; a slurry of bleached pulp fibers combined with whitewater and broke; broke; and whitewater. The slurry of bleached pulp fibers, whether or not combined with whitewater and/or broke may also be one that is diluted. Dilution may occur at any one or more of a pulp chest, a blending chest, a machine chest, a wire pit, a refiner (such as a deaerator, a screener and/or a cleaner), a headbox, and points therebetween. While dilution can also occur in the short circuit of a papermaking process, it may also occur during stock preparation.

Each of the above types of papermaking compositions includes pulp fibers, a colloid phase and an aqueous phase, except for the whitewater which comprises a colloid phase and an aqueous phase.

Colloids are an intimate mixture of a solid in an aqueous phase. The colloid phase is uniformly distributed in an aqueous phase in a finely divided state. The aqueous phase is sometimes called the dispersion or dispersing medium. The size of the substances in the colloid phase can vary in size between 10 to 10,000 angstroms or larger. The colloid phase includes, without limitation, solid inorganic compounds, solid calcium carbonate associated with surfactants and/or crystalline modifiers, solid organic compounds, such as polymers, liquid organic compounds insoluble with water, fiber fines, other fines, filler particles, and sizing particles. Crystalline modifiers include materials which act as "seeds" around which dissolved calcium carbonate precipitates during the process in which the solid calcium carbonate is produced.

The aqueous phase of the papermaking composition includes various species dissolved in water, such as cations, anions, and non-charged species. A typical cation includes $Ca^{++}$. A typical anion includes $HCO_3^-$ and $CO_3^{2-}$.

As best illustrated in FIG. 1, a typical short circuit of a papermaking process includes the following components. Pulp from a pulp chest 1 is provided to a blend chest 4. It should be noted that the pulp is not in dried form, but rather exists in a slurry of pulp fibers, a colloid phase and an aqueous phase. Thus, it is included within the meaning of "papermaking composition". Also, while only one pulp chest is depicted, use of more than one type of pulp or more than one pulp chest is included in the invention.

Other pulp fibers, another colloid phase containing fines, as well as an aqueous phase from disc filter 7 are also provided to blend chest 4. The various pulps, colloid phases and aqueous phases are blended to result in a fiber consistency slightly lower than that of the pulp slurry in the pulp chest. The resultant diluted slurry is then provided to the machine chest 10, where it is further diluted and provided to wire pit 13 where it is even further diluted. This more diluted slurry is then provided to the refiner 16 where it is deaerated, screened, and/or cleaned. From there, the refined slurry is provided to headbox 19, where it is further diluted.

At headbox 19, the flow of diluted, refined slurry is horizontally distributed such that when it reaches the papermaking wire 22, the flow of diluted, refined slurry covers the entire upper surface of papermaking wire 22. At papermaking wire 22, the diluted, refined slurry is dewatered to provide a wet web of paper for further processing.

Much of the aqueous phase and at least some of the colloid phase is not retained by the papermaking wire 22, but instead is collected from a lower surface of papermaking wire 22 as whitewater 25. Whitewater 25 is recycled back to the wire pit 13 and disc filter 7. At least some of the aqueous phase and colloid phase from the whitewater 25 exits disc filter 7 to whitewater storage 34, where it is used in various portions of a papermaking facility, including pulp stock preparation. At least some of the aqueous phase and colloid phase from the white water exits disc filter 7 to be blended with pulp at blend chest 4. Whitewater 25 includes a colloid phase (including fines) and an aqueous phase.

Portions of the wet, web of paper, or a dried web of paper that are found unsuitable are combined in mill water and/or whitewater to provide broke 28. The broke 28 is collected at broke system 31 where it is further refined and then provided to disc filter 7 and to blend chest 4. At least a portion of the broke exits disc filter 7 to be blended with pulp at blend chest 4. Broke 28 includes pulp fibers, a colloid phase and an aqueous phase.

Those skilled in the art will recognize the method of the invention may be performed in many other papermaking systems in which adjustment of the electrical properties of papermaking compositions would be beneficial.

If desired, the electrical property may be measured by a suitable measuring device. The measuring device may be off-line, such as in a laboratory, or on-line. If an on-line measuring device is used, it may be placed at any point in the process and system described above. Similarly, if an off-line device is used, samples may be taken from any papermaking composition from any point in the process and system described above. For example, an electrical property of the pulp fibers of the broke may be measured by placing an on-line measuring device anywhere broke is found, or by taking a sample of the broke at any point.

There are several types of devices suitable for measuring zeta potential. Many of these devices use any one of electrophoresis, streaming current, streaming potential, and electro osmosis. Zeta potential measurement devices based upon the streaming potential principle, which include laboratory and industrial online ones, operate in the following manner. During the measurement, liquid is forced through a plug formed from pulp fibers, fines and other furnish components using a pressure gradient. The streaming potential is measured across the plug established by the flowing liquid using electrodes placed on either side of the plug. The zeta potential is calculated using the following formula:

$$\zeta=(\eta*I_s*\kappa)/(\epsilon_o*\epsilon*\Delta P)$$

where:

$\zeta$=Zeta Potential $I_s$=Streaming potential (potential between two electrodes)

$\kappa$=Conductivity of the liquid $\eta$=Viscosity of the flowing solution $\epsilon_o$=Electric field constant $\epsilon$=Dielectric constant of the liquid $\Delta P$=Liquid pressure drop across the pad There are several suitable devices available for measuring electrical charge demand. As one skilled in the art will understand, electrical charge demand is the amount of electrically charged titrant that is needed to titrate a sample to a zero potential. The electrical charge demand may measure any one or more of the charged properties of polymers, colloids, and fine particles in a sample, as well as dissolved anions or cations.

One suitable device for measuring electrical charge demand is the Particle Charge Detector PCD-03. It should be noted that while this device and measurement method refer to "particle" charge, the device and method actually measure the charge demand of the sample, in many instances, that of dissolved ionic species. While the PCD may be used for all types of papermaking compositions, it is often used for measurement of samples in which the pulp fibers have been filtered out, such as pulp slurry filtrates, broke filtrates, and whitewater.

Measurements made with the PCD 03 are based on the following principle. The central element is a plastic measuring cell with a fitted displacement piston. If an aqueous sample is filled into the measuring cell, molecules will adsorb at the plastic surface of the piston and on the cell wall under the action of Van der Wall forces. The counter-ions remain comparatively free. A defined narrow gap is provided between cell wall and piston. Driven by a motor, the piston oscillates in the measuring cell and creates an intensive liquid flow that entrains the free counter-ions, thus separating them from the adsorbed sample material. At the built-in electrodes, the counter-ions induce a current which is rectified and amplified electronically. The streaming current is shown on the display with the appropriate sign.

For quantitative charge measurements of the sample, a Polyelectrolyte titration has to be conducted which uses the streaming current to identify the point of zero charge (0 mV). Available titrators include the Mutek Titrator PCD-02 Version 1.

With use of a titrator, an oppositely charged polyelectrolyte of known charge density is added to the sample as a titrant. The titrant charges neutralize existing charges of the sample. Titration is discontinued as soon as the point of zero charge (0 mV) is reached. Titrant consumption in mL is the actual measured value which forms the basis for further calculations. For anionic samples the titrant used is such as polydimethyl diallyl ammonium chloride (Poly-Dadmac) 0.001 N.

The specific charge quantity q [eq/g] is calculated according to the formula:

$$q=(V*c)/\text{wt}$$

where:

V=consumed titrant volume (L)

c=titrant concentration [eq/L]

wt=weight of the sample [g]

If several identical samples are to be compared, the charge quantity q does not have to be calculated provided the samples are titrated under identical conditions, i.e., at the same sample weight and titrant concentrations. In this case, the measured volume of consumed titrant in mL may be directly used and the values obtained are directly comparable. In this context, the terms anionic and cationic demand of a sample are in common use.

Whichever type of measuring device is selected, it may be used to monitor the value of the electrical property in order to maintain or improve quality production with minimal raw materials costs. However, even if the electrical properties are carefully monitored, these measurements are less useful if there are unsuitable methods for adjusting the values based upon the electrical properties. In order to solve this problem, we have surprisingly found that carbon dioxide may be introduced into any of the papermaking compositions in order to adjust the electrical property value at hand. It may be advantageously used to adjust a value that is undesirable for some reason towards a value that is more acceptable. It can also be used to adjust an electrical property value to a predetermined value or range of values, such as for example, a value or values that have been identified as optimal by skilled artisans or via models.

When gaseous carbon dioxide ($CO_{2(g)}$) is introduced to an aqueous system, such as a papermaking composition, a portion of the $CO_{2(g)}$ will be solubilized into free $CO_{2\ (aq)}$, as shown in the following reaction:

$$CO_{2(gas)} \leftrightarrows CO_{2(aq)}$$

When $CO_2$ dissolves in water, it hydrates to yield carbonic acid ($H_2CO_3$). It should be noted that this reaction is slow (Ionic Equilibrium-Solubility and pH Calculations" by J. N. Butler, John Wiley & Sons, INC., 1998, chapter 10, p. 365). $H_2CO_3$ can dissociate into $H^+$ and $HCO_3^-$ ions, as shown in the following reaction:

$$H_2CO_3 \leftrightarrows H^+ + HCO_3^-$$

Generation of these ions is important in adjusting electrical properties of the pulp fibers, pulp fines, and colloids.

The carbon dioxide may be introduced by any method suitable for introducing gases into papermaking compositions, including without limitation, by pressurization or sparging.

As an example of practice of the invention, a positive zeta potential may be made less positive. Without being bound by any particular theory, we believe that dissolved $HCO_3^-$ ions produced by hydration of carbon dioxide in water and their subsequent disassociation thereof become attracted to positively charged pulp fibers and/or colloids, thus lowering the positive zeta. Theoretically, this may continue until a zero zeta potential is reached. Introduction of carbon dioxide is advantageous in light of prior attempts to solve the zeta potential control problem, because it lessens the need to add chemical additives designed to adjust the zeta potential. If carbon dioxide is not introduced and the additive need is not decreased, these additives will often build up in a papermaking process with the disadvantages described above.

As another example, a negative zeta potential may be made less negative. Often, those skilled in the art will observe that a zeta potential at some point in the papermaking process is unacceptably low. This is often considered a deviation, upset or cause for attention. In that case, carbon dioxide may be used to efficiently and effectively raise such overly negative zeta potentials.

Additionally, with control over the amount of carbon dioxide introduced, one skilled in the art may adjust the zeta potential towards a desired zeta potential range or even a discrete zeta potential. Surprisingly, we have found that, for a given pH change, the zeta potential may be adjusted by a greater amount through carbon dioxide introduction, than by conventional additives.

In light of this disclosed invention, those skilled in the art will appreciate and understand how to control and/or adjust a zeta potential in a portion or portions of a papermaking process by using knowledge developed while running papermaking processes. They will similarly be able to diagnose a zeta potential deviation or system upset.

Practice of the invention is equally applicable with respect to an electrical charge demand. If it is unacceptably high, introduction of carbon dioxide into the papermaking composition unexpectedly decreases the overall demand by a surprising amount.

Similarly, the invention may be practiced with respect to conductivity. Surprisingly, introduction of carbon dioxide into the papermaking composition increases it by an unexpected amount.

One skilled in the art will also understand that the streaming potential can similarly be adjusted or controlled.

These adjustments may be achieved in an even more surprising manner when calcium salts are present, especially calcium carbonate. The results obtained when calcium carbonate is present do not significantly change if the form of the calcium carbonate is different, such as precipitated calcium carbonate (PCC) vs. ground calcium carbonate (GCC).

Furthermore, practice of this invention has also achieved startling adjustments to pulp slurries when carbon dioxide is introduced to calcium carbonate slurries before the calcium carbonate slurries are combined with the pulp slurries. When this is performed, the resulting zeta potential adjustment is much more desirable in comparison to when the calcium carbonate is introduced without carbon dioxide.

EXAMPLES

Sample Preparation

In a first set of experiments, two different pulp slurries were used and identified as slurry Type 1 and slurry Type 2.

Slurry Type 1: The chemically pulped and bleached hardwood (HW) and softwood (SW) pulps used to produce this slurry were obtained from Econotech Service, Derwent, B.C., Canada. Pulp species used included northern hardwood, namely Aspen, and northern softwoods. The obtained pulp sheets were refined using a Valley beater based on TAPPI test method no (T 200 sp-96). The hardwood and softwood were refined to a freeness of 450 and 430 Canadian Standard Freeness (CSF), respectively.

The 0.5% consistency (Cy) pulp slurry Type 1, was prepared using in a proportion of 60% HW and 40% SW. The pulp slurry was prepared using deionized water. The mixer used to prepare the slurry was the "Square D" mixer from IEC Controls. The resulting mixed pulp slurry was stored at 3° C. Samples of this slurry were equilibrated to room temperature (20±2° C.) before proceeding with experimentation.

The initial properties of of the Type 1 slurry are shown in Table 2A.

TABLE 2A

| Slurry Compositions | | |
|---|---|---|
| Pulp Slurry | Type 1 | Type 2 |
| Consistency | 0.5% | 4.0% |
| HW content | 60% | 69%* |
| SW content | 40% | 31%* |
| Recycled | 0% | 100% |
| Ash Content | na | 16.5% (525° C.)*, 9.8% (900° C.)* |

*Determined by Econotech Services.

Slurry Type 2 was generated by repulping virgin standard copy paper. One package of 500 sheets of Office Max Premium Quality Copy Paper was repulped in a Lamort Pulper de Laboratoire. The specification of the copy paper were:

3-Hole Punch 8.5×11 Letter size white

20# Basis Weight

84 Brightness

Acid free.

Slurry Type 2 was prepared by introducing 1,503 g of the copy paper, and a total of 12.0 liters of hot tap water to the Lamort repulper. During the repulping process, two mixing speed settings were used: (1) high (total mixing time: 2 min) and (2) low (total mixing time: 8 min). The mixing speed sequences were varied during the repulping process. What does this mean? The repulped slurry was diluted with deionized water to produce the slurry Type 2 having a consistency of 4.0%.

The initial properties of of the Type 2 slurry are shown in Table 2B.

TABLE 2B

| Measured Slurry Properties | | |
|---|---|---|
| Pulp Slurry | Type 1 | Type 2 |
| pH | 5.35 | 8.90 |
| Conductivity | 0.0121 mS | 0.089 mS |
| Zeta Potential | −127.3 mV | −45.3 mV |
| Inlet Potential | 8.44 mV | 3.04 mV |
| Pressure | 0.201 bar | 0.219 bar |

*Initial pulp slurry properties indicated in this table (average values) correspond to pulp slurry properties measured at different times (i.e., not successive measurement of the same pulp slurry).

When deionized water is used to prepare the slurries, there is almost no conductivity. Therefore, this results in very negative zeta potentials.

In the second set of experiments, two different solutions were used. The first solution consisted of a wet end filtrate stream (filtered through 200 mesh). The second solution consisted of a 5× dilution of mill white water (deionized water was used for dilution). Both types of solutions/filtrates were supplied by Abitibi-Consolidated in Beaupre, Quebec. The undiluted white water had an extremely high conductivity and anionic charge associated with it. Because a relatively lower conductivity and anionic charge are more appropriately measured by the associated measuring devices the white water was diluted 5×. Consult Table 2C for solution properties.

TABLE 2C

| Mill Filtrate and Diluted White Water Properties | | |
|---|---|---|
| | Mill Filtrate Properties | Diluted White Water Properties |
| Temperature | 21.5° C.* | 22.6° C.* |
| pH | 7.92 | 8.18 |
| Conductivity | 5420 μS/cm | 1391 μS/cm |
| TDS | 4500 ppm (442) | 962.4 ppm (442) |
| PCD (10.0 mL sample) [diluted 5x] | 11.976 mL Poly-Dadmac (0.001 N) | 8.594 mL Poly-Dadmac (0.001 N) |

*Temperature of sample during analysis.

Testing Conditions: Repeatability and Reproducibility

The zeta potential measuring device used for the testing was a "Mutek-model no. SZP 06" meter, available from BTG Industries, Norcross, Ga. In an effort to evaluate the repeatability of the Mutek device (SZP-06), five measurements of the same sample (500.0 g) were taken. For this repeatability test, Type 1 slurry was pH adjusted to 10.65 using NaOH (1.019 N concentration) supplied by Aldrich. The results are shown in Table 3.

TABLE 3

| Repeatability of the Mutek SZP-06 | | | | |
|---|---|---|---|---|
| Reading | Zeta Potential (mV) | Conductivity (mS) | Pressure (Bar) | Inlet Potential (mV) |
| 1 | −102.5 | 0.151 | 0.195 | 5.79 |
| 2 | −101.9 | 0.150 | 0.195 | 5.76 |
| 3 | −102.3 | 0.149 | 0.195 | 5.79 |
| 4 | −102.4 | 0.148 | 0.197 | 5.86 |
| 5 | −100.4 | 0.147 | 0.196 | 5.72 |
| avg. | −101.9 | 0.149 | 0.196 | 5.78 |
| std. dev. | 0.87 | 0.002 | 0.001 | 0.051 |

In an effort to evaluate the the reproducibility of the Mutek device, different samples (5) of the same slurry preparation (slurry Type 1) were measured using the Mutek device. For this particular sample, $CaCO_3$ (Precipitated Calcium Carbonate-PCC) was added to the pulp slurry. The slurry was mixed in the IEC mixer at 900 rpm for a total time of 90 minutes. 15% of PCC was added to the pulp slurry based on the initial oven dry weight of the fiber.

TABLE 4A

| Reproducibility of the Mutek SZP-60 With Slurry I | | | | |
|---|---|---|---|---|
| Reading | Zeta Potential (mV) | Conductivity (mS) | Pressure (Bar) | Inlet Potential (mV) |
| 1 | −44.0 | 0.101 | 0.209 | 2.79 |
| 2 | −43.6 | 0.102 | 0.207 | 2.73 |
| 3 | −43.2 | 0.102 | 0.207 | 2.71 |
| 4 | −44.2 | 0.101 | 0.206 | 2.76 |
| 5 | −42.9 | 0.101 | 0.213 | 2.77 |
| avg. | −43.6 | 0.101 | 0.208 | 2.75 |
| std. dev. | 0.54 | 0.0005 | 0.003 | 0.032 |

In a further effort to evaluate the reproducibility of the Mutek device, five portions of a pulp diluted in mill white water were measured. The pulp was an 80/20 mixture of the chemically pulped and bleached HW and SW pulps described above. The result pulp slurry was mixed in the IEC mixer at 900 rpm for a total time of 10 minutes.

TABLE 4B

| Reproducibility of the Mutek SZP-06 With Pulp Diluted in White Water | | | | | | |
|---|---|---|---|---|---|---|
| Beaker | Zeta | Conductivity | Pressure | Streaming Potential mV | Mean mV Signal Variation | Mean Pressure Variation |
| 1 | −29.4 | 4.49 | 203 | −0.361 | 0.004 | 0.966 |
| 2 | −32.5 | 4.44 | 204 | −0.405 | 0.004 | 0.931 |
| 3 | −33.7 | 4.44 | 201 | −0.415 | 0.005 | 1 |
| 4 | −36.1 | 4.29 | 202 | −0.459 | 0.006 | 0.724 |
| 5 | −32.1 | 4.23 | 203 | −0.415 | 0.003 | 1.172 |
| 6 | −32.5 | 4.31 | 204 | −0.416 | 0.003 | 0.897 |

TABLE 4B-continued

Reproducibility of the Mutek SZP-06 With Pulp Diluted in White Water

| Beaker | Zeta | Conductivity | Pressure | Streaming Potential mV | Mean mV Signal Variation | Mean Pressure Variation |
|---|---|---|---|---|---|---|
| Avg | −32.717 | 4.37 | 202.83 | −0.41 | 0.004 | 0.948 |
| Standard Dev | 2.1858 | 0.104 | 1.17 | 0.03 | 0.001 | 0.146 |

Effect of pH Variations on the Zeta Potential of the Pulp Slurry

Two types of experiments were performed to investigate the effect of pH variations on the zeta potential of the pulp slurry. For both types of experiments, slurry Type 1 was pH adjusted to 10.20 using 1.019 N sodium hydroxide (NaOH).

First, incremental additions of 0.1 N sulfuric acid ($H_2SO_4$) (from Aldrich) were added to 500 g of pulp slurry (slurry Type 1). After each incremental acid addition, the pulp slurry was mixed at 700 rpm for 2 minutes using a Caframo mixer (Model RZR-2000). Once the sample was well mixed, the pH was measured, and the Mutek device was used to determine the zeta potential, conductivity, inlet potential, and pressure.

Secondly, gaseous carbon dioxide ($CO_2$) (from Air Liquide) was used to vary the pH of the slurry. The carbon dioxide flow rate was regulated using a mass flow controller (model MKS type 246B from MKS Instruments) and supplied to the solution by using a ¼ inch stainless steel "dip" tube. The pulp was mixed using a laboratory mixer (Model RZR-2000) at 200 rpm for varying amounts of time and $CO_2$ flow rates (see Table 5 for $CO_2$ flow rates and sparging time).

TABLE 5

Effect of $CO_2$ Addition on the Zeta Potential

| Sample | $CO_2$ (variable Flow Rate) (mL/min) | Time (min) | $CO_2$ (cumulative) (mL) | pH | Zeta Potential (mV) |
|---|---|---|---|---|---|
| 1 | na | na | na | 10.20 | −113.0 |
| 2 | 50 | 2 | 100 | 6.53 | −111.4 |
| 3 | 50 | 3 | 250 | 6.08 | −107.7 |
| 4 | 100 | 3.25 | 565 | 5.76 | −106.8 |
| 5 | 350 | 5 | 2315 | 5.50 | −106.2 |
| 6 | 1000 | 6.5 | 8815 | 5.10 | −103.5 |
| 7 | 1400 | 4.5 | 15115 | 4.70 | −96.7 |
| 8 | 2000 | 4.5 | 24115 | 4.68 | −92.3 |
| 9 | 2000 | 4.5 | 33115 | 4.65 | −91.0 |

Figure 2:
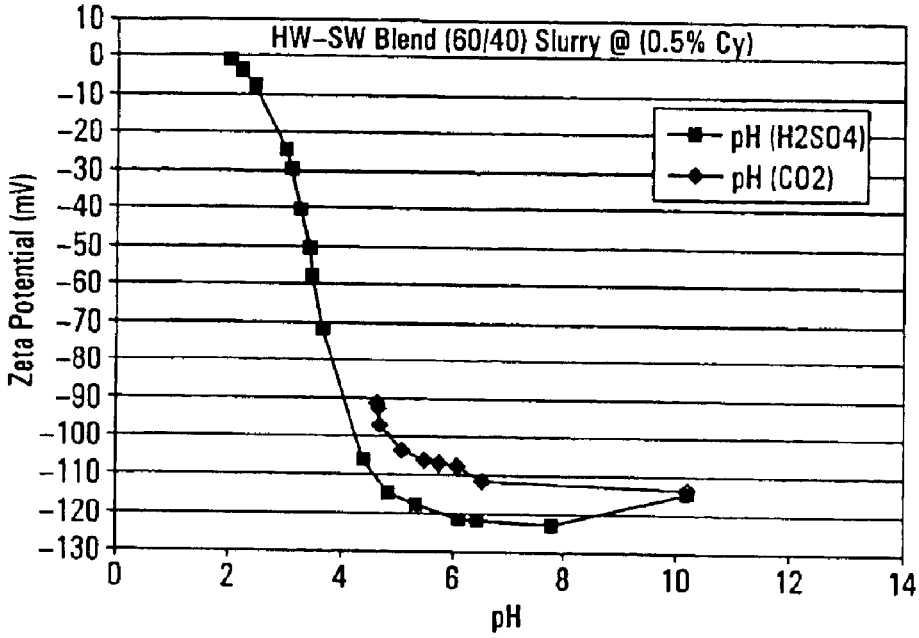
FIG. 2 is a graph showing the effect upon zeta potential by $CO_2$ and $H_2SO_4$ for various pH ranges.

From the results in FIG. 2, it is seen that when $H_2SO_4$ was used to acidify the slurry, a sudden modification in the zeta potential occurred at a pulp slurry pH of approximately 5.0. However, previous acidification (from pH 10.20 to pH ~5.0) had an insignificant effect on the zeta potential.

Adding $CO_2$ to pulp slurry also modified the zeta potential. However, in these experiments, it was only possible to decrease the pH from 10.20 to pH 4.65, because carbonic acid is a weak acid. $CO_2$ addition after a pH of 4.65 did not decrease the pH, and no increase in the zeta potential was observed.

Surprisingly, the results, as best shown in FIG. 2, show that in the pH range of 10.20 to 4.65, $CO_2$ was more effective than $H_2SO_4$, with respect to modifying the zeta potential of the pulp slurry. In the pH range of interest to a papermaker (4 to 8), the zeta potential modification was greater for a unit change in pH when $CO_2$ was used vs. use of $H_2$ $SO_4$. Also, for a same zeta potential obtained by $H_2SO_4$ in comparison to $CO_2$, a much greater drop in pH was required by the adjustment with $H_2SO_4$. This is important because pH changes affect many other conditions in the wet end, or short circuit, of the papermaking process. Thus, it is evident that practice of the invention produces results that would be greatly unexpected in comparison to those obtained by conventional methods of addition $H_2SO_4$.

To examine the effect of initial pH of the pulp slurry, an experiment similar to the two above was performed using non-pH adjusted slurry Type I. Incremental modifications to pH were done using $CO_2$. The experimental conditions used for the experiments were identical to the conditions used for pH adjusted slurry as described earlier. Comparative results are shown in Table 6. It should be noted that results from Table 5 are included again, in Table 6, to show the difference in initial pH adjusting.

As the data show in Table 6, the advantageous effect of carbon dioxide addition upon zeta potential does not depend upon an intial pH or upon pH ranges.

TABLE 6

Effect of Initial pH when Supplying $CO_2$ to Pulp Slurries

| Sample | $CO_2$ (mL) | pH | Zeta Potential (mV) | $CO_2$ (mL) | pH | Zeta Potential (mV) |
|---|---|---|---|---|---|---|
| 1 | 0 | 5.04 | −129.0 | 0 | 10.20 | −113.0 |
| 2 | 200 | 4.65 | −121.0 | 100 | 6.53 | −111.4 |
| 3 | 400 | 4.60 | −125.5 | 250 | 6.08 | −107.7 |
| 4 | 600 | 4.53 | −125.3 | 565 | 5.76 | −106.8 |
| 5 | 1200 | 4.41 | −122.3 | 2315 | 5.50 | −106.2 |
| 6 | 2400 | 4.27 | −122.1 | 8815 | 5.10 | −103.5 |
| 7 | 4800 | 4.19 | −116.0 | 15115 | 4.70 | −96.7 |
| 8 | — | — | — | 24115 | 4.68 | −92.3 |
| 9 | — | — | — | 33115 | 4.65 | −91.0 |

Effect of Salt Addition to the Slurry Upon Zeta Potential

An experiment was also performed to investigate the effect of salt addition upon the zeta potential. Salt solutions of potassium chloride (KCl), sodium chloride (NaCl), calcium chloride ($CaCl_2$), and aluminum chloride ($AlCl_3$) were added to the pulp slurry Type I. To prepare the KCl, NaCL and CaCl2 solutions, reagent grade chemicals supplied by Fisher Scientific were dissolved in deionized water. The $AlCl_3$ solution was supplied by LabChem. The Al concentration of the $AlCl_3$ solution was determined by Graphite Furnace Atomic Absorption Spectrometer (GFAA), model SIMAA 6000 from Perkin Elmer. The concentrations of the prepared solutions are shown in Table 7.

TABLE 7

Concentration of Prepared Salt Solutions

| Compound | Concentration of Salt Solution |
|---|---|
| KCl | 0.5 mol/L |
| NaCl | 0.5 mol/L |
| $CaCl_2$ | 0.5 mol/L |
| $AlCl_3$ | 13500 ppm (as Al) |

The prepared solutions were added to 500.0 g samples of pulp slurry (Type 1), and mixed at 700 rpm for 5 min., using a Caframo mixer (Model RZR-2000). After mixing, the Mutek device used to determine the zeta potential. The results are graphically displayed in FIG. 3.

Figure 3:
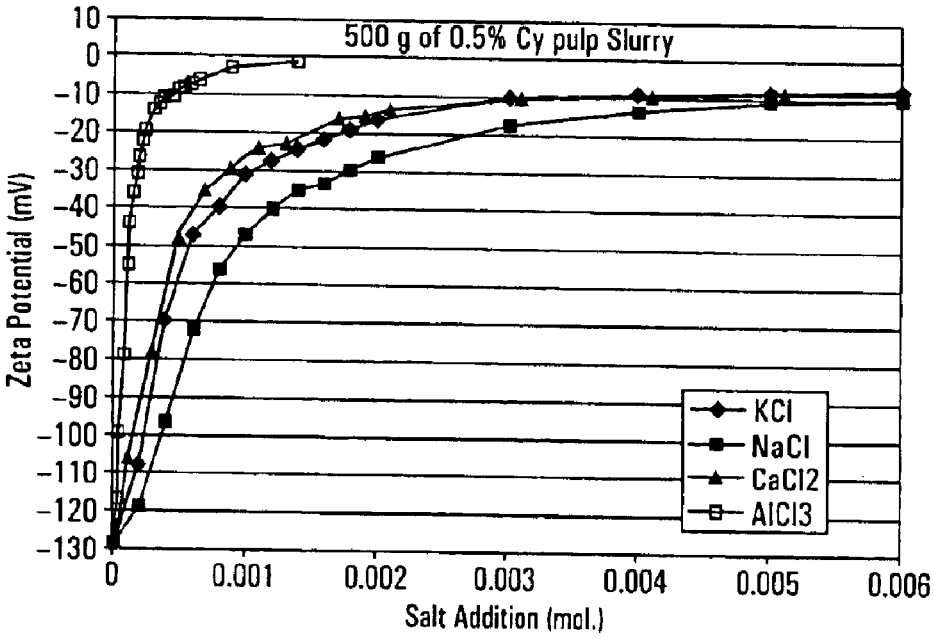
FIG. 3 is a graph showing the effect upon zeta potential of various concentrations of various salts.

As best shown in FIG. 3, the zeta potentials of the pulp slurries vary depending on the type of salt used, or more specifically the valency of the corresponding cation. These results are in accordance with similar types of experiments performed by others (A. M Scallan and J.Grignon, Svensk Papperstidning nr2, 1979, page 40). Some have been proposed that the cations are attracted to the negatively-charged outer surfaces of the fibers in suspension and, depending upon their charge and hydrated diameters, either contract or expand the thickness of the double layer (Cohen, W. E., Farrant, G. and Watson, A. J.: Proc. Aust. Pulp Paper Ind. Tech. Assoc.3 (1949) 72.

Figure 4:
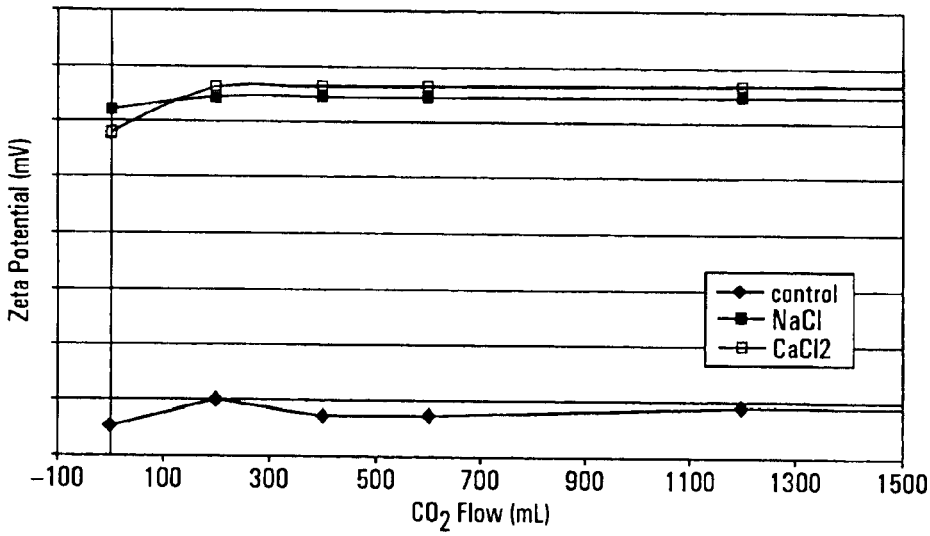
FIG. 4 is a graph showing the effect upon zeta by $CO_2$ for various salt additions.

An experiment was also performed to investigate the effect of $CO_2$ and salt addition (of NaCl and $CaCl_2$) upon the zeta potential. In these experiments, 8.8 mL of the 0.5mol/L NaCl and $CaCl_2$ solutions were added to the Type I slurry (corresponding to 0.0044 mol of NaCl and $CaCl_2$). The combination was then mixed using the Caframo mixer at 700 rpm for 5 min. Carbon dioxide gas was introduced into the pulp slurry containing salt using a ¼ inch stainless steel "dip" tube. The flow rate of $CO_2$ was maintained at 500 mL/min. The slurry was mixed at 200 rpm while the $CO_2$ was added. The results are shown in FIG. 4. It should also be noted that in FIG. 4, the experiment coded as control corresponds to a pulp slurry to which no salt was added.

The results show that the zeta potential may be adjusted by addition of carbon dioxide whether or not salts are present.

Effect of Calcium Carbonate Addition on the Zeta Potential:

These experiments were performed using slurry Type 1. The initial pH of the pulp slurry was adjusted to 10.65 using 1.019 N NaOH. The slurry was pH adjusted to minimize $CaCO_3$ dissociation in the slurry. The $CaCO_3$ was added to 500.0 g. of pulp slurry (at 0.5% consistency). The slurry was then mixed at 700 rpm for 5 min using a Caframo mixer. Subsequently, measurements were performed using the Mutek SZP-06 meter; also, pH was measured. The GCC and PCC amount was added based on the oven dry weight of pulp. The results are shown in Table 8. Ground calcium carbonate (GCC) was obtained from OMYA (Omyafil), and precipitated calcium carbonate (PCC) was obtained from Specialty Minerals Inc (Albacar HO #(A-8–124–32)).

TABLE 8

Effect of Calcium Carbonate the Zeta Potential

| Type | Ash, % | pH | Zeta mV | Conductivity (mS) | Pressure (Bar) | Inlet Potential (mV) |
|---|---|---|---|---|---|---|
| Initial | 0 | 10.65 | −101.9 | 0.149 | 0.196 | 5.78 |
| GCC | 5 | 10.29 | −88.7 | 0.154 | 0.200 | 5.11 |
| | 10 | 10.21 | −96.2 | 0.151 | 0.201 | 5.61 |
| | 15 | 10.03 | −100.6 | 0.112 | 0.207 | 6.17 |
| | 30 | 9.88 | −102.4 | 0.132 | 0.207 | 6.20 |
| PCC | 5 | 9.90 | −98.2 | 0.113 | 0.207 | 6.06 |
| | 10 | np | np | np | np | np |
| | 15 | 10.06 | −108.5 | 0.114 | 0.203 | 6.59 |
| | 30 | 9.90 | −111.7 | 0.114 | 0.196 | 6.55 |

np: not performed

As seen above, the addition of PCC or GCC initially tends to increase the zeta potential, then decrease it. Similarly, addition of PCC or GCC initially tends to increase the conductivity, then decrease it. As such, addition of PCC or GCC to a papermaking process may introduced an undesirable amount of uncertainty in the zeta potential or conductivity.

Effect of Calcium Carbonate and Carbon Dioxide Addition on the Zeta Potential:

These experiments were performed using slurry Type 1. Two different types of calcium carbonate $CaCO_3$) were used for experiments to determine the effect on zeta potential. Ground calcium carbonate (GCC) was obtained from OMYA (Omyafil), and precipitated calcium carbonate (PCC) was obtained from Specialty Minerals Inc (Albacar HO # (A-8–124–32)).

Figure 5:
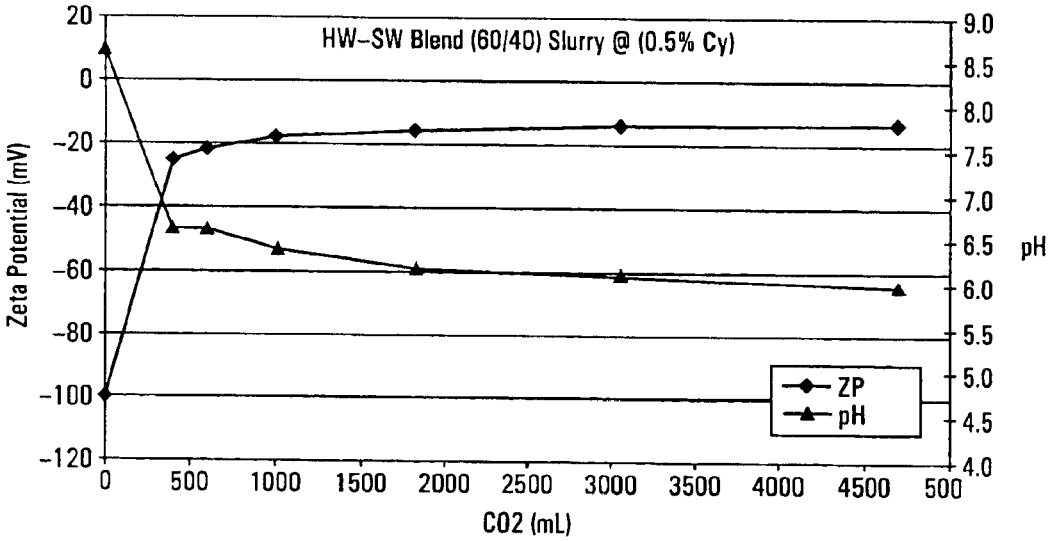
FIG. 5 is a graph showing the effect upon zeta by the addition of $CO_2$ and calcium carbonate.

The $CaCO_3$ was added to 500.0 g. of pulp slurry (at 0.5% consistency), and the slurry was mixed at 700 rpm for 5 min using a Caframo mixer. The calcium carbonate (GCC) 15% on pulp was based on the initial oven dry weight of the pulp and the entire amount of calcium carbonate was added prior to $CO_2$ addition. Carbon dioxide gas was introduced at a flow rate of 500 mL/min. using a ¼ inch stainless steel "dip" tube. During $CO_2$ addition to the slurry, the sample was mixed at 200 rpm using a Caframo mixer. Subsequent measurements were performed using the Mutek SZP-06 meter. Also, the pH was measured. The results are shown in FIG. 5.

Figure 6:
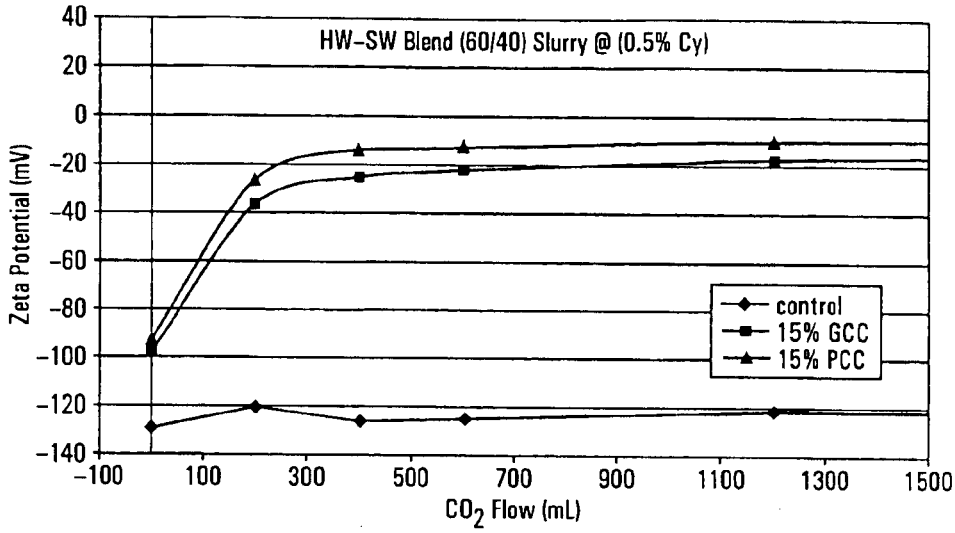
FIG. 6 is a graph comparing the effect upon zeta by GCC and PCC at various flow rates of $CO_2$.

In order to compare the type and source of calcium carbonate upon $CO_2$ addition, a comparative experiment was performed using PCC. The carbon dioxide addition flow rate was fixed at 500 mL/min., and the initial concentration of PCC was fixed at 15% on the oven dry weight of pulp. The comparative results between GCC and PCC are presented in FIG. 6.

To investigate the effect of introducing $CO_2$ into slurries containing different PCC and GCC levels, the previously discussed samples (see Table 8) were utilized for experimentation. During the experiments, CO2 was added at two different levels: 200 mL and 2400 mL. For the experiments in which 200 mL of $CO_2$ was introduced to the slurry samples, the flow rate was 250 mL/min.; whereas for the experiments in which 2400 mL of $CO_2$ were introduced to the slurry samples, a flow rate of 500 mL/min was used. To mix the slurries a Caframo mixer was used. As previously mentioned the mixing speed during $CaCO_3$ addition was 700 rpm for 5 min. During $CO_2$ addition the mixing speed was fixed at 200 rpm. Results for these experiments are indicated in Tables 9 and 10.

As the data show, not only have we found that carbon dioxide introduction may be used to advantageously and surprisingly adjust the zeta potential of a slurry, we have further found that when the slurry contains solid calcium carbonate, the results are even more unexpected. In this instance, it is increased. Moreover, despite the lowering effect upon the zeta potential by the addition of solid calcium carbonate, carbon dioxide reverses that lowering effect and then some. Also, we have found that the effect of carbon dioxide upon zeta potential in the presence of solid calcium carbonate does not depend upon the form of the solid calcium carbonate, such as PCC vs. GCC.

TABLE 9

Effect of $CO_2$ Addition in the Presence of PCC

| Samples | PH | Zeta (mV) | Cond. (mS) | Pressure (Bar) | Inlet Potential (mV) |
|---|---|---|---|---|---|
| Pulp at 0.5% Cy | 10.65 | 101.9 | 0.149 | 0.196 | 5.78 |
| Add CaCO3-PCC (5% ash) | 9.90 | −98.2 | 0.113 | 0.207 | 6.06 |
| 200 mL CO2 | 7.74 | −55.1 | 0.139 | 0.207 | 3.34 |
| 2400 mL CO2 | 6.16 | −20.3 | 0.345 | 0.206 | 1.05 |
| Add CaCO3-PCC (15% ash) | 10.06 | −108.5 | 0.114 | 0.203 | 6.59 |
| 200 mL CO2 | 7.88 | −54.7 | 0.146 | 0.205 | 3.26 |
| 2400 mL CO2 | 6.62 | −13.0 | 0.599 | 0.199 | 0.54 |
| Add CaCO3-PCC (30% ash) | 9.90 | −111.7 | 0.114 | 0.196 | 6.55 |
| 200 mL CO2 | 8.00 | −40.4 | 0.156 | 0.199 | 2.32 |
| 2400 mL CO2 | 6.53 | −10.1 | 0.635 | 0.203 | 0.42 |

TABLE 10

Effect of $CO_2$ Addition in the Presence of GCC

| Samples | PH | Zeta (mV) | Cond. (mS) | Pressure (Bar) | Inlet Potential (mV) |
|---|---|---|---|---|---|
| Pulp at 0.5% Cy | 10.65 | −101.9 | 0.149 | 0.196 | 5.78 |
| Add CaCO3-GCC (5% ash) | 10.29 | −88.7 | 0.154 | 0.200 | 5.11 |
| 200 mL CO2 | 8.16 | −73.0 | 0.110 | 0.198 | 4.34 |
| 2400 mL CO2 | 6.16 | −24.6 | 0.328 | 0.204 | 1.26 |
| Add CaCO3-GCC (10% ash) | 10.21 | −96.5 | 0.151 | 0.201 | 5.61 |
| 200 mL CO2 | 8.60 | −77.1 | 0.113 | 0.201 | 4.64 |
| 2400 mL CO2 | 6.45 | −22.6 | 0.411 | 0.204 | 1.09 |
| Add CaCO3-GCC (15% ash) | Na | −100.6 | 0.112 | 0.207 | 6.20 |
| 200 mL CO2 | 8.02 | −56.0 | 0.131 | 0.206 | 3.40 |
| 2400 mL CO2 | 6.32 | −18.6 | 0.488 | 0.204 | 0.87 |
| Add CaCO3-GCC (30% ash) | 9.88 | −102.4 | 0.132 | 0.207 | 6.20 |
| 200 mL CO2 | 8.32 | −66.8 | 0.135 | 0.205 | 4.02 |
| 2400 mL CO2 | na | −20.7 | 0.558 | 0.207 | 0.92 |

We also investigated the effect of "reduced" $CO_2$ addition to the slurry. The following experiments were performed using slurry Type 1. A fixed dosage of PCC at 15% on oven dry weight of pulp was added to the slurry. The PCC and slurry (10,000 g) were mixed at 900 rpm for 90 minutes using the IEC mixer. On the slurry was prepared, $CO_2$ was added to 500 g. samples of the slurry/PCC mixture. The $CO_2$ flow rate was fixed at 50 mL/min (through ¼ inch "dip" tube) and mixing during $CO_2$ addition was performed at 200 rpm using a Caframo mixer.

TABLE 11

Zeta Potential Variations in the Presence of Calcium Carbonate

| Time (sec) | Zeta Potential (mV) | Conductivity (mS) | Pressure (bar) | Inlet Potential (mV) | Residual $Ca^{++}$ Concentration (ppm) |
|---|---|---|---|---|---|
| 0 | −43.6 | 0.101 | 0.208 | 2.75 | — |
| 10 | −36.3 | 0.121 | 0.199 | 2.15 | 15 |
| 20 | −35.1 | 0.132 | 0.198 | 2.05 | 18 |
| 30 | −34.3 | 0.145 | 0.206 | 1.94 | 20 |
| 40 | −33.7 | 0.148 | 0.202 | 1.98 | 22 |
| 50 | −33.2 | 0.154 | 0.202 | 1.94 | 24 |
| 60 | −31.7 | 0.163 | 0.202 | 1.84 | 26 |
| 90 | −28.5 | 0.186 | 0.202 | 1.62 | 28 |
| 120 | −25.9 | 0.211 | 0.202 | 1.44 | 31 |

Figure 7:
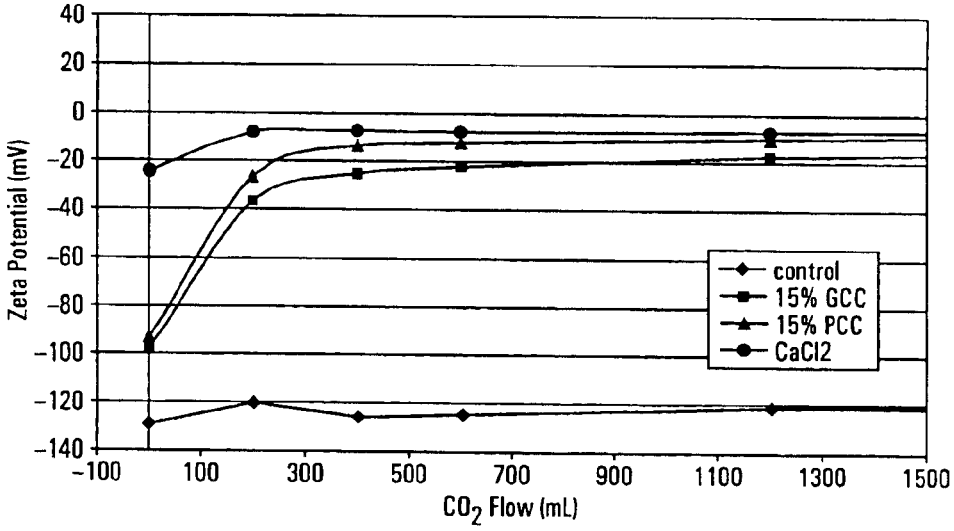
FIG. 7 is a graph showing the effect upon zeta by various calcium salts in the presence of $CO_2$.

Residual $Ca^{2+}$ concentration was measured using an calcium ion selective electrode (ISE) (#24502–08) distributed by Cole-Parmer Instruments; and the IONS 5 meter from Oakton. It should be noted that the samples were filtered using 0.45 micron filters (from Pall Gelman Laboratory) before using the calcium ISE. Surprisingly, the results show that when the volume of $CO_2$ increased (as indicated by time), the zeta potential and conductivity also increased. Also, the residual $Ca^{2++}$ concentration increased Effect of Various Calcium Salts on the Zeta Potential in the Presence of $CO_2$:

In FIG. 7, all previously discussed experimental data, in which calcium containing salts were used, are plotted. In addition, the results of an experiment in which calcium acetate (0.5 mol/L solution) was added to the slurry, is also plotted. It should be noted that the one variable that was fixed in these experiments was the amount (concentration) of calcium added to the 500 g sample of slurry Type 1. In all the experiments show in FIG. 7, the amount of calcium added to a 500 g slurry sample was 0.0044 mole. As in the previous experiments, the flow rate of $CO_2$ was fixed at 500 mL/min. After calcium acetate addition, the mixture was mixed for 5 min. at 700 rpm using a Caframo mixer. During $CO_2$ addition, the mixture was mixed at 200 rpm.

As shown in FIG. 7, addition of carbon dioxide unexpectedly adjusted/increased the zeta potential when calcium salts were present. Even more unexpected is the significant increase in zeta potential when solid calcium carbonate (PCC or GCC) is present.

Figure 8:
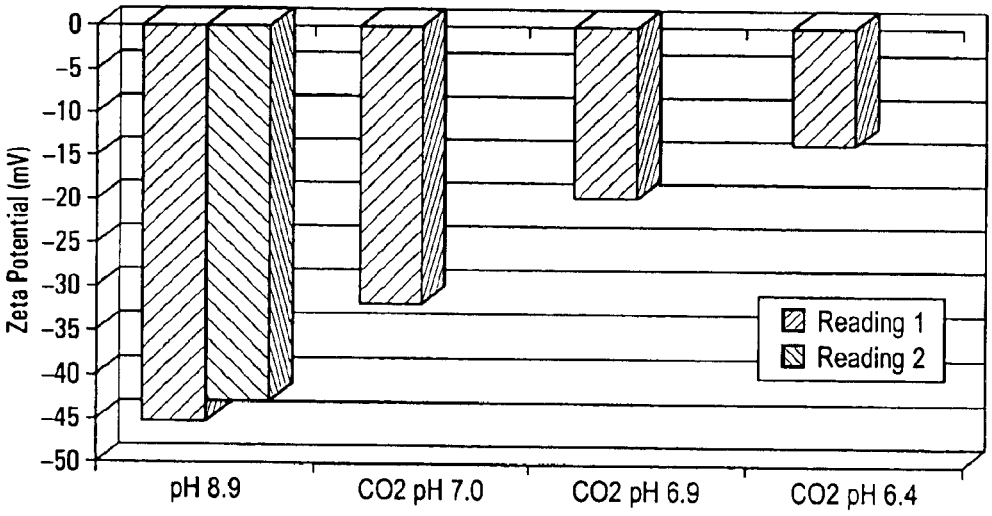
FIG. 8 is a graph showing the effect upon zeta by a repulped composition not containing calcium carbonate.

Effect of on the Zeta Potential Due to $CO_2$ Addition on Recycled Furnishes:

To investigate the effect of adding $CO_2$ to repulped slurries, slurry Type 2 was used. It is important to note that $CaCO_3$was not added to these samples. In these experiments, $CO_2$ was added to the slurry by using a ¼ inch stainless steel "dip" tube. The $CO_2$ flow rate was 750 mL/min. The first observation that can be made, is that the zeta potential of the system is relatively low compared to slurry Type 1 (−127.3. mV avg. vs. −45.3 mV avg). This is understandable, since the repulped slurry contains a considerable quantity of ash (i.e., $CaCO_3$ filler). Moreover, tap water (hardness) was used for the repulping process (i.e., to generate the 10% Cy slurry). The data are shown in FIG. 8.

Surprisingly, addition of carbon dioxide not only adjusts/increases zeta potential in slurries made from pulp, pulp containing calcium salts, pulp containing calcium carbonate, but also does so for recycled furnishes, such as broke.

$CO_2$ Addition to $CaCO_3$ Prior to Mixing with the Pulp Slurries:

We also tested the effect of addition of carbon dioxide to calcium carbonate slurries prior to introduction of the calcium carbonate slurry to a pulp slurry.

First a 60/40 HW/SW blend was prepared (see Table 2B for Properties). Next, a 10% $CaCO_3$ (PCC) slurry was prepared (using PCC in deionized water) and divided into five 200 mL samples. Next, a constant $CO_2$ flow rate of 500 mL/min was added to each of the 200 mL PCC slurry samples. During the $CO_2$ addition the PCC slurry was mixed at 400 rpm (using the Caframo mixer model RZR-2000). The carbon dioxide flow rate was regulated using a mass flow controller (model MKS type 246B from MKS Instruments) and was supplied to the solution by using a ¼ inch stainless steel "dip" tube. For four of the samples, the volume of carbon dioxide added was investigated. The fifth sample was used as a control and did not receive any carbon dioxide. The $CO_2$ volumes were 500 mL $CO_2$, 2500 mL $CO_2$, 7500 mL $CO_2$ and, 14000 mL $CO_2$.

2.5 mL of the PCC/$CO_2$ slurries were then added to four 500 g samples of the pulp slurry at 0.5% Cy. After the PCC addition, the resultant slurry was mixed at 700 rpm for ten minutes (using the Caframo mixer). Next, the Mutek SZP device was used to analyze the samples (pulp slurries). The pH and temperature were also measured. The results are presented in Table 12.

Unexpectedly, the data show that the zeta potential may be increased and the conductivity decreased from an initial pulp slurry when carbon dioxide is first added to a calcium carbonate slurry that is later added to the pulp slurry. Indeed, the invention is not limited to addition of carbon dioxide to pulp or pulp fines—containing compositions. Rather addition of carbon dioxide may be performed upon calcium carbonate slurries which are later introduced to the pulp or pulp fines—containing compositions with adjustments of their electrical properties.

TABLE 12

$CO_2$ Addition to $CaCO_3$ Prior to Mixing with the Pulp Slurries:

| Sample # | $CO_2$ volume (mL) | Temperature (° C.) | pH | Zeta Potential (mV) | Conductivity (mS) |
|---|---|---|---|---|---|
| 1 | 0 | 22.5 | 9.20 | −106.0 | 0.0456 |
| 2 | 500 | 22.5 | 9.19 | −103.1 | 0.0469 |
| 3 | 2500 | 22.5 | 8.85 | −96.7 | 0.0546 |
| 4 | 7500 | 22.5 | 8.95 | −95.9 | 0.0559 |
| 5 | 14000 | 22.5 | 8.91 | −90.5 | 0.0627 |

Effect of $CO_2$ on the PCD of a Diluted White Water Solution

To investigate the effect of adding $CO_2$ to diluted white water (see Table 2C for diluted white water properties), experiments were conducted in a glass vessel reactor in which a hollow shaft mixer (i.e., hollow shaft and hollowed Rushton turbine for gas recirculation) was used. The reactor, which can be sealed, has an exact volume of 2,620 mL and is manufactured by Verre-Labo Mula (France). $CO_2$ is added through ¼ tube immersed in the solution (or slurry) to which a sparger has been fixed.

For each experiment, 1,000 g of the diluted (5×) white water was introduced into the reactor. It should be noted that for these experiments, $CaCO_3$ was not added to the diluted white water sample. The reactor was sealed, and then the contents were mixed at 1500 rpm. Once the reactor contents had been mixed for 5 minutes, the $CO_2$ was introduced to the reactor and the contents mixed for 15 minutes at 1500 rpm. Three different $CO_2$ dosages were investigated during this brief study. Results are shown in Table 13.

As shown in Table 13, the data surprisingly show that $CO_2$ addition can effectively lower the electrical charge demand even on white water.

TABLE 13

Effect of $CO_2$ on the PCD and Conductivity of a diluted white water solution.

| | Diluted White Water | $CO_2$ Dosage (g) | | |
|---|---|---|---|---|
| | Properties | 0.1612 g | 0.3240 g | 1.6223 g |
| Temperature | 22.6° C. | 22.5° C. | 21.8° C. | 21.9° C. |
| pH | 8.18 | 6.63 | 6.38 | 5.76 |
| Conductivity | 1391 μS/cm | 1374 μS/cm | 1364 μS/cm | 1372 μS/cm |
| TDS | 962.4 ppm | 1005 ppm | 999 ppm | 1005 ppm |
| PCD (10.0 mL sample) | 8.594 mL Poly-Dadmac (0.001 N) | 7.578 mL Poly-Dadmac (0.001 N) | 7.213 mL Poly-Dadmac (0.001 N) | 6.988 mL Poly-Dadmac (0.001 N) |

Effect of $CO_2$ on the PCD of a Diluted White Water Solution Containing $Caco_3$ To investigate the effect of adding $CO_2$ to diluted white water (see Table 2C for diluted white water properties) to which PCC has been added (prior to carbon dioxide addition), experiments were conducted in a glass vessel reactor in which a hollow shaft mixer (i.e., hollow shaft and hollowed Rushton turbine for gas recirculation) was used. The reactor, which can be sealed, has an exact volume of 2620 mL and is manufactured by Verre-Labo Mula (France). $CO_2$ is added through ¼ tube immersed in the solution (or slurry) to which a sparger has been fixed.

For each experiment, 990 g of the diluted (5×) white water and 10.0 g of PCC (Albacar HO, from Specialty Minerals Inc.) were introduced into the reactor. The reactor was sealed, and then the contents were mixed at 1500 rpm. Once the reactor contents had been mixed for 5 minutes, the $CO_2$ was introduced to the reactor, and the reactor contents were mixed for 15 minutes. Three different dosages were investigated during this brief study. The results are shown in Table 14.

As shown in Table 14, the data surprisingly show that addition of $CO_2$ to $CaCO_3$-spiked white water will significantly raise the conductivity and lower the PCD. In comparison to non-$CaCO_3$ spiked white water, addition of $CO_2$ will lower the PCD by a much greater amount.

TABLE 14

Effect of $CO_2$ on the PCD, Conductivity of diluted white water "spiked" with $CaCO_3$ (PCC).

| | Diluted White Water Properties (with $CaCO_3$) | CO2 Dosage (g) | | |
|---|---|---|---|---|
| | | 0.1621 g | 0.3188 g | 1.6197 g |
| Temperature | 20.8° C.* | 22.3° C. | 22.6° C. | 22.5° C. |
| pH | 8.77 | 7.57 | 7.28 | 6.70 |
| Conductivity | 1356 μS/cm | 1561 μS/cm | 1708 μS/cm | 2106 μS/cm |
| TDS | 994.9 ppm | 1157 ppm | 1264 ppm | 1598 ppm |
| PCD (10.0 mL sample) | 6.791 mL Poly-Dadmac (0.001 N) | 5.104 mL Poly-Dadmac (0.001 N) | 4.874 mL Poly-Dadmac (0.001 N) | 3.060 mL Poly-Dadmac (0.001 N) |

Effect of $CO_2$ Comparison with $H_2SO_4$:

These experiments were performed using the hollow shaft reactor (previously described). In these experiments, $CO_2$ was added to 1000 g of the diluted white water and mixed for 10 minutes at 1500 rpm (using the hollow shaft configuration). The pH, temperature, conductivity, TDS, and PCD were recorded. Afterwards, 10.0 g. of the white water was removed from the reactor and 10.0 g of PCC were added. The pH adjusted white water/PCC mixture was mixed for 10 minutes and then the sample was analyzed for pH, temperature, conductivity, TDS, and PCD.

The exact same experiment was performed, with the exception that the $CO_2$ was replaced by $H_2SO_4$. In other words, the acid was used to achieve same target pH as that obtained after $CO_2$ addition (i.e., pH=6.39). In Table 17, the results from this brief study are presented. In the table, it is shown that 0.573 g of 4.0 Normal $H_2SO_4$ were needed to get a pH of 6.39.

The results show that when using $CO_2$ compared to $H_2SO_4$ to reach same target pH level, the PCD of the sample was slightly lower when the acid was used. After PCC addition, the sample in which $CO_2$ was used for initial pH adjustment had a much lower PCD then the acid pH adjusted sample.

The sulfuric acid used for these experiments was provided by Fisher Scientific certified ACS at a concentration of 4 N.

As the data show in Table 15, addition of CO2 will increase the conductivity much more so than $H_2SO_4$ for additions reaching a same pH. Also, addition of $CO_2$ will increase the conductivity much more so than $H_2SO_4$ for additions reaching a same pH. Also, addition of $CO_2$ will decrease the electrical charge demand much more so than $H_2SO_4$ for additions reaching a same pH.

TABLE 15

Effect of pH change agent.

| | Temp (° C.) | Cond (μS/cm) | TDS (ppm) | pH | PCD (mL) |
|---|---|---|---|---|---|
| Baseline | 22.6 | 1391 | 962.4 | 8.18 | 8.594 |
| $CO_2$ (0.3228 g $CO_2$) | 20.8 | 1388 | 1020 | 6.39 | 7.848 |
| PCC (10.0 g PCC added) | 20.9 | 1503 | 1113 | 7.97 | 5.007 |
| $H2SO_4$ (0.573 g 4 N) | 21.5 | 1504 | 1114 | 6.39 | 7.491 |
| PCC (10.0 g PCC added) | 21.8 | 1541 | 1142 | 8.67 | 6.097 |

Effect of CO2 on the Zeta Potential and PCD of "Dirty" Pulp Slurries:

This experiment was performed to determine to what extent introducing CO2 to a CaCO3 containing so-called "dirty" pulp slurry would modify both the Zeta potential and the PCD. The pulps used to prepare both slurries was chemically pulped and bleached hardwood (HW) and softwood (SW) obtained from an unidentifiable source located in British Columbia, and prepared by Econotech Service, Derwent, B.C., Canada. Pulp species used were northern hardwood, namely Aspen, and northern softwoods. The purchased market pulp sheets were refined using a Valley beater based on TAPPI test method no. T 200 sp-96. The hardwood and softwood were refined to a freeness of 461 and 451 Canadian Standard Freeness (CSF), respectively.

The pulp slurry consistency used in this experiments was 2.5% consistency (Cy). The pulp slurry was prepared using a proportion of 80% HW and 20% SW. The pulp slurry was prepared using a 10× dilution of the previously mentioned white water (from mill situated in Beaupre, Quebec, Canada [Abitibi-Consolidated]). It should be also noted that the mixer used to prepare the slurry was the "Square D" mixer from IEC Controls.

First, the white water was diluted by ten times, i.e., 10× dilution. Next, a pulp slurry was prepared at 2.5% Cy with a 80/20 HW/SW blend with the dilute white water. 1300 g of the pulp slurry were added to the reactor and mixed at 1500 rpm for 30 minutes. Baseline measurements were then taken. 13.93 g of PCC was then added and the combination mixed for 15 minutes.

The zeta potential, pH, temperature, conductivity, TDS, and PCD were measured and recorded. Also 25 mL of sample (filtered through 200 mesh) was taken to perform the PCD test. A $CO_2$ dosage equivalent to 10 kg/ton fiber were then added and mixed for 15 minutes. The zeta potential, the pH, temperature, conductivity, TDS, and PCD were then measured recorded.

This experiment was conducted in a glass vessel reactor in which a hollow shaft mixer (i.e., hollow shaft and hollowed Rushton turbine for gas recirculation was used). The reactor has an exact volume of 2,620 mL and is manufactured by Verre-Labo Mula (France). For this experiment, the reactor was sealed during $CO_2$ adelivery and subsequent mixing. As the data in Table 16 show, addition of $CO_2$ to slurries approximating those found in papermaking processes will lower the electrical charge demand and increase the zeta potential.

TABLE 16

Effect of Carbon Dioxide Upon the Zeta Potential, Conductivity, and Electrical Charge Demand for "Dirty" Pulp Samples

| | Temperature (° C.) | Conductivity (μS/cm) | TDS (ppm) | pH | Zeta Potential (mV) | PCD (mL) |
|---|---|---|---|---|---|---|
| ww/tap water 10% ww | 23.4 | 878.4 | 629.2 | 8.20 | na | 2.835 |
| Baseline 80/20 pulp slurry | 22.3 | 824.7 | 590 | 7.12 | −26.2 | 2.824 |
| PCC 30% (13.93 g) | 22.3 | 861.2 | 617.5 | 8.50 | −32.3 | 1.791 |
| CO2 (10 kg/ton) | 22.4 | 1065.0 | 772.4 | 7.46 | −20.7 | 1.033 |

As shown above, the data unexpectedly show that slurries containing pulp, calcium carbonate and white water had their electrical properties of conductivity, zeta potential and electrical charge demand significantly adjusted. In particular, the electrical charge demand and zeta potential were lowered, while the conductivity was increased in a surprising manner.

As seen in the foregoing examples, introduction of carbon dioxide into papermaking compositions surprisingly adjusts electrical properties of the constituent components, and thus those of papermaking compositions. This results in many benefits to papermakers. First, addition of carbon dioxide will not tend to build up over time such that the papermaking process will need to be shut down for an undesirable amount of time. Second, addition of carbon dioxide lessens, or maybe even eliminates, the need for costly additives whose chemical reactivity is not known to a desirable degree of certainty. Third, addition of carbon dioxide may be performed at many different points in the papermaking process, such as in stock preparation, points in the short circuit, and in calcium carbonate slurries before introduction of them into pulp slurries.

Those skilled in the art will understand that the scope of the invention is not limited to the specific embodiments or examples above.

We claim:

1. A method for modifying electrical properties of papermaking compositions, said method comprising the steps of:

providing at least one papermaking composition comprising a colloid phase, an aqueous phase, and optionally pulp fibers, wherein each of the colloid phase, aqueous phase, and optional pulp fibers of one of the at least one papermaking composition has an electrical property and an associated value based upon the electrical property;

introducing carbon dioxide into at least one of the at least one papermaking composition in an amount; and substantially adjusting the associated electrical property value, wherein said step of substantially adjusting is achieved by performing said step of introducing carbon dioxide.

2. The method of 1, wherein:

the at least one papermaking composition further comprises solid calcium carbonate;

at least a portion of the solid calcium carbonate is dissolved upon said step of introducing carbon dioxide.

3. The method of claim 1, further comprising the steps of:

selecting first, second, third, and optional fourth papermaking compositions as the at least one papermaking composition, wherein the first papermaking composition is a pulp slurry that includes pulp fibers, the second papermaking composition is broke that includes pulp fibers, the third papermaking composition is whitewater which does not include a substantial amount of pulp fibers, and the optional fourth papermaking composition is a diluted version of the first papermaking composition;

optionally diluting the first papermaking composition thereby providing the optional fourth papermaking composition;

allowing the pulp fibers of the first or optional fourth papermaking composition to be dewatered on a papermaking wire downstream of the vessel, and at which the second and third papermaking compositions are produced.

4. The method of claim 3, further comprising the steps of:

selecting the first papermaking composition as the at least one papermaking composition into which carbon dioxide is introduced.

5. The method of claim 3, further comprising the steps of:

selecting the second papermaking composition as the at least one papermaking composition into which carbon dioxide is introduced.

6. The method of claim 3, further comprising the steps of:

selecting the third papermaking composition as the at least one papermaking composition into which carbon dioxide is introduced.

7. The method of claim 3, further comprising:

selecting dilution of the first papermaking composition as said step of optionally diluting the first papermaking composition, thereby providing the fourth papermaking composition;

selecting the provided optional fourth papermaking composition as the at least one papermaking composition into which carbon dioxide is introduced.

8. The method of claim 3, wherein:

the associated electrical property value is based upon zeta potential.

9. The method of claim 3, wherein:

the associated electrical property value is based upon conductivity.

10. The method of claim 3, wherein:

the associated electrical property value is based upon electrical charge demand.

11. The method of claim 3, wherein:

the associated electrical property value is based upon streaming potential.

12. The method of claim 8, wherein:

the associated zeta potential value of at least one of the colloid phase and optional fibers of at least one of the first, second, third and optional fourth papermaking compositions is negative and adjustment thereof renders it less negative.

13. The method of claim 8, wherein:

the associated zeta potential value of at least one of the colloid phase and optional fibers of at least one of the first, second, third and optional fourth papermaking compositions is positive and adjustment thereof renders it less positive.

14. The method of claim 9, wherein:

the associated conductivity value of at least one of the colloid phase and optional fibers of at least one of the first, second, third and optional fourth papermaking compositions is increased by the adjustment.

15. The method of claim 10, wherein:

the associated conductivity value of at least one of the colloid phase and optional fibers of at least one of the first, second, third and optional fourth papermaking compositions is decreased by the adjustment.

16. The method of claim 8, wherein:

the at least one papermaking composition into which carbon dioxide is introduced includes pulp fibers present at a consistency of at least 3%.

17. The method of claim 12, wherein:

the at least one papermaking composition into which carbon dioxide is introduced includes pulp fibers present at a consistency of at least 3%.

18. The method of claim 3, further comprising the step of:

selecting dilution of the papermaking composition as said step of optionally diluting the first papermaking composition, thereby providing the fourth papermaking composition;

providing a pulp chest for providing a supply of the first papermaking composition;

providing a blend chest which receives the first papermaking composition from the pulp chest and blends, wherein said step of selecting dilution is performed at the blend chest to yield the fourth papermaking composition;

providing a machine chest which receives the fourth papermaking composition from the blend chest and dilutes the fourth papermaking composition;

providing a wire pit which receives the diluted fourth papermaking composition from the machine chest and further dilutes the fourth papermaking composition;

providing a refiner which receives the fourth papermaking composition from the wire pit and deaerates, screens, and/or cleans the fourth papermaking composition;

providing a headbox which receives the fourth papermaking composition and distributes the pulp fibers therein across an upper surface of the paperwire, the headbox being downstream of the pulp chest; and selecting a point whereat the carbon dioxide is introduced, the selected point being at or downstream of the pulp chest and non-adjacently upstream of the headbox.

19. The method of claim 3, further comprising the steps of:

selecting zeta potential as the electrical property;

selecting the first papermaking composition as the least one papermaking composition into which carbon dioxide is introduced;

selecting a consistency of fibers for the first papermaking composition of at least 3%;

selecting a predetermined zeta potential value or range of values;

measuring the zeta potential of at least one of the colloid phase, aqueous phase and optional fibers;

comparing the measured value to the predetermined value or range of values; and selecting an amount of the introduced carbon dioxide based upon said comparing step.

20. The method of claim 3, further comprising the steps of:

selecting dilution of the first papermaking composition as said step of optionally diluting the first papermaking composition, thereby providing the fourth papermaking composition;

selecting zeta potential as the electrical property;

selecting the fourth papermaking composition as the at least one papermaking composition into which carbon dioxide is introduced;

selecting a predetermined zeta potential value or range of values;

measuring the zeta potential of at least one of the colloid phase, aqueous phase and optional fibers;

comparing the measured value to the predetermined value; and selecting an amount of the introduced carbon dioxide based upon said comparing step.

21. The method of claim 3, further comprising the steps of:

selecting zeta potential as the electrical property;

selecting the second papermaking composition as the at least one papermaking composition into which carbon dioxide is introduced;

selecting a predetermined zeta potential value or range of values;

measuring the zeta potential of at least one of the colloid phase, aqueous phase and optional fibers;

comparing the measured value to the predetermined value or range of values; and selecting an amount of the introduced carbon dioxide based upon said comparing step.

22. The method of claim 3, further comprising the steps of:

selecting zeta potential as the electrical property;

selecting the third papermaking composition as the at least one papermaking composition into which carbon dioxide is introduced;

selecting a predetermined zeta potential value or range of values;

measuring the zeta potential of at least one of the colloid phase, aqueous phase and optional fibers;

comparing the measured value to the predetermined value or range of values; and selecting an amount of the introduced carbon dioxide based upon said comparing step.

23. The method of claim 3, further comprising the steps of:

selecting a predetermined value or range of values based upon the electrical property; and measuring the electrical property of at least one of the colloid phase, aqueous phase and optional pulp fibers of at least one of the at least one papermaking composition thereby obtained a measured value, wherein the adjusted value is closer to the predetermined value than the measured value.

24. The method for modifying electrical properties of papermaking compositions, said method comprising the steps of:

providing at least one papermaking composition comprising a colloid phase, an aqueous phase, and optionally pulp fibers, wherein each of the colloid phase, aqueous phase, and optional pulp fibers of one of the at least one papermaking composition has an electrical property and an associated value based upon the electrical property;

introducing carbon dioxide into at least one of the at least one papermaking composition in an amount such that the associated electrical property value is substantially adjusted;

selecting a predetermined value or predetermined range of values based upon the electrical property; and measuring the electrical property of at least one of the colloid phase, aqueous phase and optional pulp fibers of at least one of the at least one papermaking composition thereby obtained a measured value, wherein the adjusted value is closer to the predetermined value or range of values than the measured value.

25. The method of claim 12, further comprising the steps of:

comparing the measured value to the predetermined value or range of values;

selecting an amount of the introduced carbon dioxide based upon said comparing step.

26. The method of claim 24, wherein:

the at least one papermaking composition into which carbon dioxide is introduced includes pulp fibers present at a consistency of at least 3%.

27. The method of claim 25, wherein:

the at least one papermaking composition into which carbon dioxide is introduced includes pulp fibers present at a consistency of at least 3%.

28. The method of claim 24, further comprising the step of:

controlling the amount of carbon dioxide introduced with a regulating device, the regulating device performing said comparing step.

29. The method of claim 27, wherein the regulating device includes a programmable logic controller.

30. A method for modifying electrical properties of papermaking compositions, said method comprising the step of:

providing at least one papermaking composition comprising a colloid phase, an aqueous phase, and optionally pulp fibers, wherein each of the colloid phase, aqueous phase, and optional pulp fibers of one of the at least one papermaking composition has an electrical property and an associated value based upon the electrical property; and introducing carbon dioxide into at least one of the least one papermaking composition in an amount such that the associated electrical property value is substantially adjusted, wherein:

the at least one papermaking composition into which carbon dioxide is introduced includes pulp fibers present at a consistency of at least 3%.

31. A method for reducing an amount of chemical additives introduced to a papermaking composition, said method comprising the steps of:

providing at least one papermaking composition comprising a colloid phase, an aqueous phase, and optionally pulp fibers, wherein each of the colloid phase, aqueous phase, and optional pulp fibers of one of the at least one papermaking composition has an electrical property and an associated value based upon the electrical property;

introducing an amount of chemical additives into at least one of the at least one papermaking composition;

introducing an amount of carbon dioxide into the at least one of the at least one papermaking composition into which the chemical additives are introduced while at the same time reducing the amount of the chemical additives, the amount of carbon dioxide is such that the associated electrical property value is substantially adjusted.

32. A method for modifying electrical properties of broke in a papermaking system, said method comprising the steps of:

providing a papermaking system;

providing broke from said papermaking system, the broke comprising a colloid phase, an aqueous phase, and optionally pulp fibers, wherein each of the colloid phase, aqueous phase, and optional pulp fibers has an electrical property and an associated value based upon the electrical property;

introducing carbon dioxide into the broke in an amount; and substantially adjusting the associated electrical property value, wherein said step of substantially adjusting is achieved by performing said step of introducing carbon dioxide.

* * * * *